US008885853B2

(12) United States Patent
Yamashita et al.

(10) Patent No.: US 8,885,853 B2
(45) Date of Patent: Nov. 11, 2014

(54) ELECTROSTATIC LOUDSPEAKER

(75) Inventors: Masayoshi Yamashita, Hamamatsu (JP); Yasuaki Takano, Kikugawa (JP)

(73) Assignee: Yamaha Corporation (JP)

( * ) Notice: Subject to any disclaimer, the term of this patent is extended or adjusted under 35 U.S.C. 154(b) by 3 days.

(21) Appl. No.: 13/809,221

(22) PCT Filed: Jul. 8, 2011

(86) PCT No.: PCT/JP2011/065738

§ 371 (c)(1),
(2), (4) Date: Jan. 9, 2013

(87) PCT Pub. No.: WO2012/005369

PCT Pub. Date: Jan. 12, 2012

(65) Prior Publication Data

US 2013/0108086 A1 May 2, 2013

(30) Foreign Application Priority Data

Jul. 9, 2010 (JP) ..... 2010-157057
Jul. 14, 2010 (JP) ..... 2010-159945

(51) Int. Cl.
*H04R 25/00* (2006.01)

(52) U.S. Cl.
USPC ..... 381/191; 381/152; 381/431

(58) Field of Classification Search
CPC ..... H04R 25/00; H04R 2440/00–2440/07; H04R 2217/00–2217/03; H04R 19/00; H04R 19/01; H04R 19/013; H04R 19/016; H04R 17/02
USPC ..... 381/152, 190–191, 173–174, 399, 431
See application file for complete search history.

(56) References Cited

U.S. PATENT DOCUMENTS 4,969,197 A * 11/1990 Takaya ..... 381/190
4,985,926 A * 1/1991 Foster ..... 381/190
6,278,790 B1 * 8/2001 Davis et al. ..... 381/190

FOREIGN PATENT DOCUMENTS

JP 58-26299 U 2/1983
JP 04-170897 A 6/1992
JP 5-78093 U 10/1993
JP 05-253038 A 10/1993
JP 2005-157947 A 6/2005
JP 2006-148612 A 6/2006
JP 2006-270663 A 10/2006
JP 2008-054154 A 3/2008
JP 2010-068053 A 3/2010

OTHER PUBLICATIONS

International Search Report for PCT/JP2011/065738. Mail date Oct. 4, 2011.
Korean Office Action for corresponding KR10-2013-7000604, mail date Jan. 20, 2014. English translation provided.
Notification of Reasons for Refusal issued in Japanese Patent Application No. 2010-157057 dated Jul. 23, 2014. English Translation provided.

* cited by examiner

*Primary Examiner* — Suhan Ni
(74) *Attorney, Agent, or Firm* — Rossi, Kimms & McDowell LLP

(57) ABSTRACT

An electrostatic loudspeaker includes: a vibrating member; an electrode disposed so as to be opposed to the vibrating member; a spacer member disposed on an opposite side of a face of the electrode, which is opposed to the vibrating member, and having acoustic transmission property; and a cover member disposed on an opposite side of a face of the spacer member, which is opposed to the electrode, and having waterproof property and insulation property.

9 Claims, 17 Drawing Sheets

ELECTROSTATIC LOUDSPEAKER

TECHNICAL FIELD

The present invention relates to an electrostatic loudspeaker.

BACKGROUND ART

As an electrostatic loudspeaker having flexibility and being foldable or bendable, the electrostatic loudspeaker disclosed in Patent Document 1 is available, for example. In this electrostatic loudspeaker, a polyester film on which aluminum is evaporated is held between two pieces of cloth woven with conductive threads, and ester wool is disposed between the film and the cloth.

In addition, the condenser headphone disclosed in Patent Document 2 has a structure in which a vibrating plate is held between fixed electrodes. Electrode foils are formed on both faces of each of the fixed electrodes, and the electrode foil on the front side is not conductive with the electrode foil on the back side. Furthermore, the fixed electrode is provided with a plurality of holes. The electrode foil positioned on the ear side of the user is connected to the ground.

PRIOR ART DOCUMENTS

Patent Documents

Patent Document 1: JP-A-2008-54154
Patent Document 2: JP-A-2006-270663

SUMMARY OF THE INVENTION

Problem that the Invention is to Solve

In the loudspeaker disclosed in Patent Document 1, the cloth serving as an electrode is exposed and is thus apt to easily make contact with a human body; if a human body touches the cloth, a current flows from the loudspeaker to the human body, and there is a possibility of electric shock.

In the headphone disclosed in Patent Document 2, since the electrode foil positioned on the ear side of a human body is grounded, even if the ear is brought close to the electrode foil positioned on the ear side of the human body, there is no danger of electric shock. However, since the holes are provided in the fixed electrodes, there is a danger that liquid, such as sweat, may enter the inside of the headphone through the holes and the insulation property thereof may be lowered.

An object of the present invention is to provide a technique for preventing electric shock and preventing insulation property from lowering in an electrostatic loudspeaker.

Means for Solving the Problems

In order to solve the above problems, according to the invention, there is provided an electrostatic loudspeaker comprising: a vibrating member; an electrode disposed so as to be opposed to the vibrating member; a spacer member disposed on an opposite side of a face of the electrode, which is opposed to the vibrating member, and having acoustic transmission property; and a cover member disposed on an opposite side of a face of the spacer member, which is opposed to the electrode, and having waterproof property and insulation property.

In the invention, the electrode may have acoustic transmission property, the vibrating member may be a vibrating membrane, an elastic member having elasticity, insulation property, and acoustic transmission property, may be disposed between the vibrating membrane and the electrode, the spacer member may be a first cover member having elasticity, the cover member may be a second cover member having acoustic transmission property, and a third cover member having acoustic transmission property may be disposed on an opposite side of a face of the second cover member, which is opposed to the first cover member.

In the invention, the second cover member may include a conductive membrane formed on an entire area of at least one face of the second cover member, and the conductive membrane may be electrically connected to a ground of a drive circuit configured to supply an acoustic signal to the electrode.

In the invention, the first cover member may be a pair of first cover members, the pair of first cover members may be disposed with the electrode, the elastic member and the vibrating membrane being held therebetween, and edges of the pair of first cover members may be firmly bonded to each other with the electrode, the elastic member and the vibrating membrane being disposed in a space formed between the pair of first cover members, the second cover member may be a pair of second cover members, the pair of second cover members may be disposed with the electrode, the elastic member, the vibrating membrane and the pair of first cover members being held therebetween, and edges of the pair of second cover members may be firmly bonded to each other with the electrode, the elastic member, the vibrating membrane and the pair of first cover members being disposed in a space formed between the pair of second cover members, and the third cover member may be a pair of third cover members, the pair of third cover members may be disposed with the electrode, the elastic member, the vibrating membrane, the pair of first cover members and the pair of second cover members being held therebetween, and edges of the pair of third cover members may be firmly bonded to each other with the electrode, the elastic member, the vibrating membrane, the pair of first cover members and the pair of second cover members being disposed in a space formed between the pair of the third cover members.

The vibrating member may have conductivity, the electrode may be a pair of electrodes disposed with the vibrating member being held therebetween, the cover member may be a pair of covers each of which includes a film having the waterproof property and the insulation property and a conductive membrane formed on an entire area of at least one face of the film, and which are disposed with the vibrating member and the pair of electrodes being held therebetween, the spacer member may be a pair of spacers each of which is disposed between the pair of covers and the pair of electrodes, and each of which has insulation property, and the pair of covers may be electrically connected to each other and connected to a ground of a drive circuit configured to supply a first acoustic signal to one of the pair of electrodes and a second acoustic signal having inverted polarity of polarity of the first acoustic signal to the other of the pair of electrodes.

In the invention, edges of the pair of covers may be firmly bonded to each other, and the vibrating member and the pair of electrodes may be disposed in a space formed between the pair of covers.

In the invention, the drive circuit may include an amplifier circuit configured to amplify an input signal, the first acoustic signal may be a signal obtained when an acoustic signal input to the amplifier circuit is amplified by the amplifier circuit so that the signal has a same phase as that of the acoustic signal, and the second acoustic signal may be a signal obtained when the acoustic signal input to the amplifier circuit is amplified by the amplifier circuit so that the signal has polarity opposite to that of the acoustic signal, and the drive circuit may include an insulating transformer in which the acoustic signal is input to one terminal on a primary side thereof, the other terminal on the primary side thereof is grounded, one terminal on a secondary side thereof is connected to the amplifier circuit, and the other terminal on the secondary side thereof is connected to the ground of the drive circuit.

Advantage of the Invention

According to the present invention, the possibility in which the human body is exposed to electric shock due to a current having flowed from the electrostatic loudspeaker can be lowered.

According to the present invention, in the electrostatic loudspeaker, electric shock can be prevented and the lowering of insulation property can be prevented.

MODE FOR CARRYING OUT THE INVENTION

First Embodiment

Figure 1:
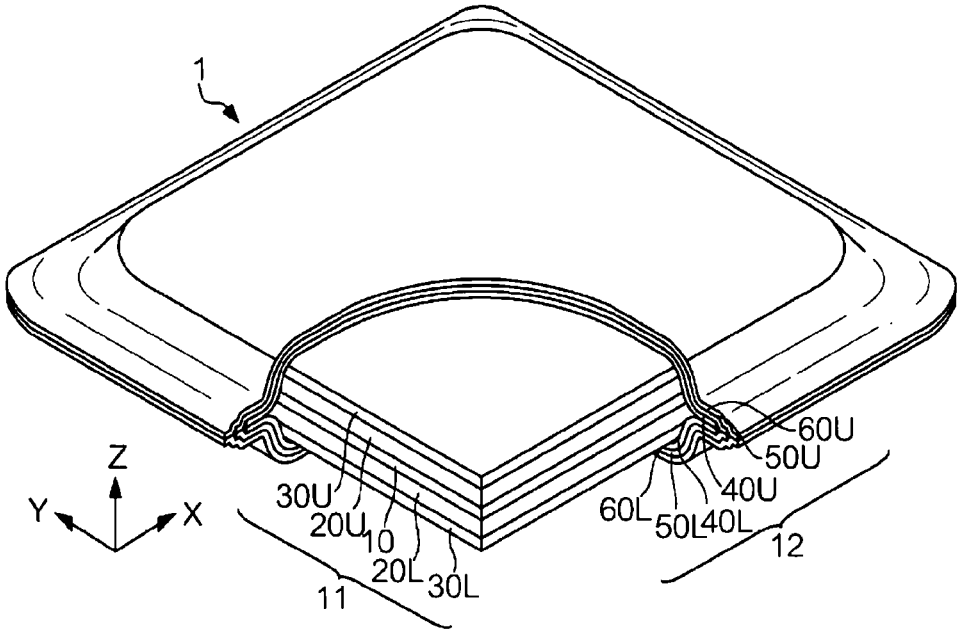
FIG. 1 is an external view showing an electrostatic loudspeaker according to a first embodiment of the present invention.
Figure 2:
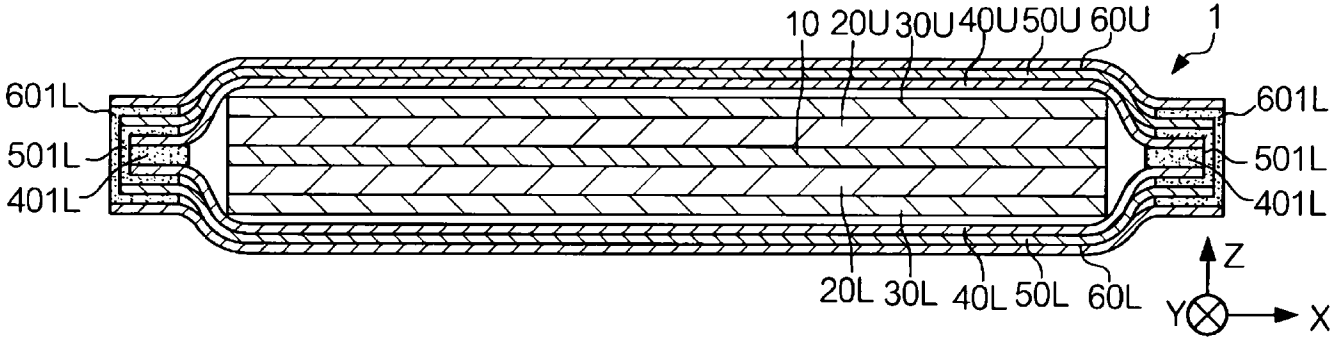
FIG. 2 is a sectional view showing the electrostatic loudspeaker.
Figure 3:
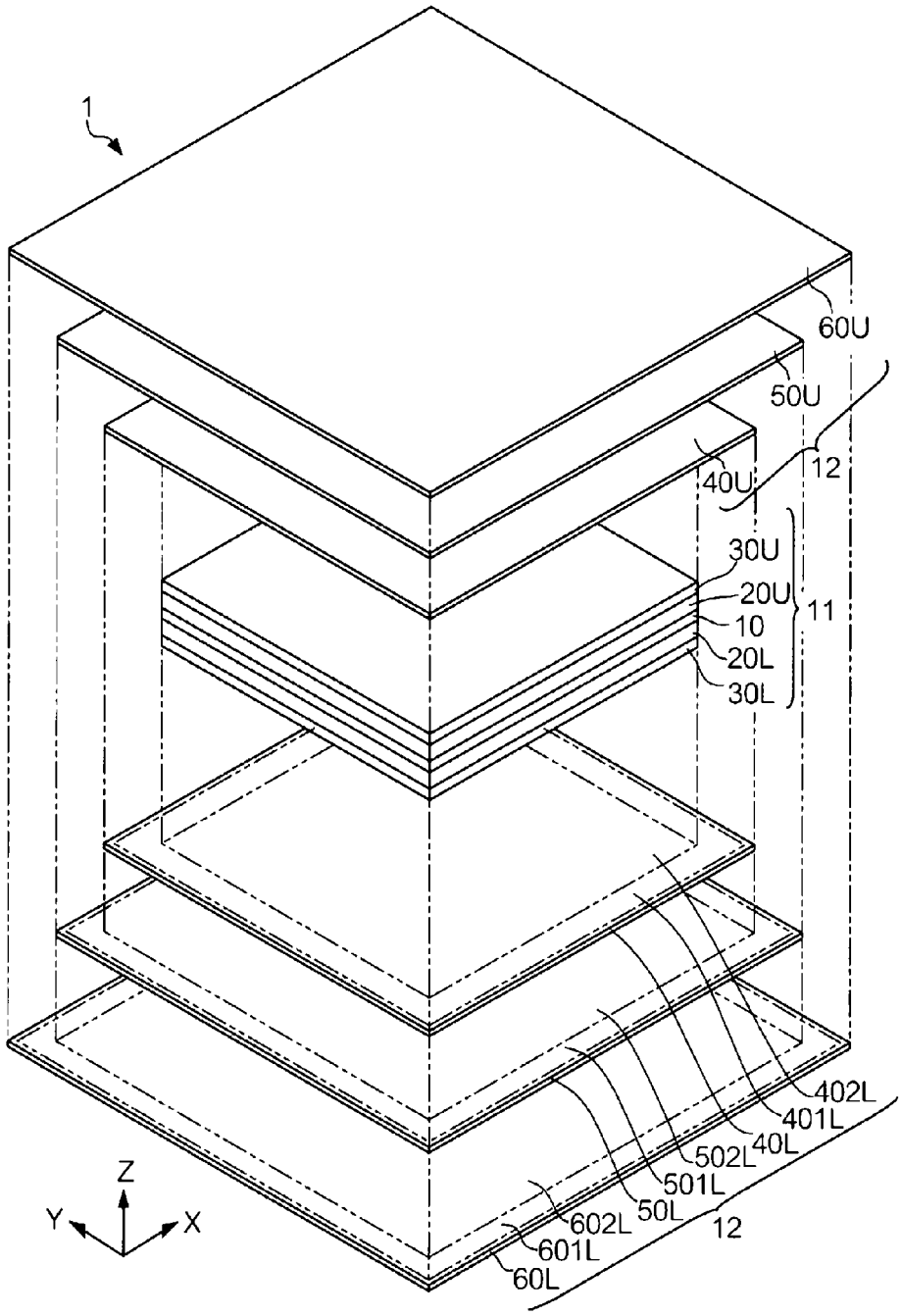
FIG. 3 is an exploded perspective view showing the electrostatic loudspeaker.

FIG. 1 is an external view showing an electrostatic loudspeaker 1 according to a first embodiment of the present invention, and FIG. 2 is a sectional view showing the electrostatic loudspeaker 1. In addition, FIG. 3 is an exploded perspective view showing the electrostatic loudspeaker 1. In these figures, the X, Y, and Z axes perpendicular to one another indicate directions, and it is assumed that the left-right direction as viewed from the front of the electrostatic loudspeaker 1 is the X-axis direction, that the depth direction is the Y-axis direction, and that the height direction is the Z-axis direction. Besides, it is assumed that "·" written in "o" in each figure means an arrow directed from the back to the front of the figure. Moreover, "×" written in "o" in each figure means an arrow directed from the front to the back of the figure. The term "front" herein denotes the direction of a face for the convenience of description, but does not denote that the electrostatic loudspeaker 1 is oriented in the front direction when it is placed. When the electrostatic loudspeaker 1 is placed, it may be placed in any direction as necessary. Still further, the dimensions of the respective components shown in the figures are made different from the actual dimensions thereof so that the shapes of the components can be understood easily.

(Configurations of the Respective Components of the Electrostatic Loudspeaker 1)

The electrostatic loudspeaker 1 is roughly divided into a main body 11 and cover members 12.

First, the configurations of various sections constituting the main body 11 of the electrostatic loudspeaker 1 will be described.

The main body 11 is equipped with a vibrating membrane 10, elastic members 20U and 20L, and electrodes 30U and 30L. In the first embodiment, the configurations of the elastic members 20U and 20L are the same, and the configurations of the electrodes 30U and 30L are the same. Hence, in the case that it is not necessary to distinguish between the two in the respective members, the descriptions of "U" and "L" are omitted.

The vibrating membrane 10 has a sheet-like configuration in which a film of a synthetic resin having insulation property and flexibility, such as PET (polyethylene terephthalate) or PP (polypropylene), is used as a base material and a conductive metal is evaporated on one face of the film to form a conductive membrane. The vibrating membrane 10 has a rectangular shape as viewed from the Z-axis direction.

The elastic members 20 are each made of non-woven cloth, do not conduct electricity and allow air and sound to pass therethrough. Each elastic member 20 has elasticity, and it is deformed when an external force is applied thereto and returns to its original shape when the external force is removed. In addition, each elastic member 20 has a rectangular shape as viewed from the Z-axis direction, and the dimensions thereof in the X-axis direction and in the Y-axis direction are the same.

The electrodes 30 each have a configuration in which a film of a synthetic resin having insulation property and flexibility, such as PET or PP, is used as a base material and a conductive metal is evaporated on one face of the film to form a conductive membrane. Each electrode 30 has a rectangular shape as viewed from the Z-axis direction, and the dimensions thereof in the X-axis direction and in the Y-axis direction are the same. Furthermore, the electrode 30 has a plurality of through-holes passing through from the front face to the back face and allows air and sound to pass therethrough. These through-holes are not shown in the figures.

Next, members constituting the cover members 12 of the electrostatic loudspeaker 1 will be described.

The cover member 12 are equipped with first cover members 40U and 40L, second cover members 50U and 50L, and third cover members 60U and 60L. In the first embodiment, the configurations of the first cover members 40U and 40L are the same, and the configurations of the second cover members 50U and 50L are the same. Furthermore, the configurations of the third cover members 60U and 60L are also the same. Hence, in the case that it is not necessary to distinguish between the two in respective members, the descriptions of "U" and "L" are omitted. In FIG. 1, parts of the cover members 12 are omitted for the convenience of description, and part of the main body 11 is exposed without being covered with the cover members 12. However, it is assumed that the main body 11 is configured so as to be entirely covered with the cover members 12.

The first cover members 40 are each made of non-woven cloth formed into a sheet shape and allow air and sound to pass therethrough. Each first cover member 40 has elasticity, and it is deformed when an external force is applied thereto and returns to its original shape when the external force is removed. Each first cover member 40 has a rectangular shape as viewed from the Z-axis direction, and the dimensions thereof in the X-axis direction and in the Y-axis direction are the same. The dimensions of the first cover member 40 in the X-axis direction and in the Y-axis direction are longer than the dimensions of the vibrating membrane 10 in the X-axis direction and in the Y-axis direction. It is preferable that the dimension of the first cover member 40 in the Z-axis direction is approximately 0.2 to 0.5 mm and that the weight per unit area thereof is approximately 20 to 50 g.

The second cover members 50 are each formed of a film of a synthetic resin having insulation property and flexibility, such as PET or PP. Furthermore, the second cover members 50 each have waterproof property and allow sound to pass therethrough. Each second cover member 50 has a rectangular shape as viewed from the Z-axis direction, and the dimensions thereof in the X-axis direction and in the Y-axis direction are the same. The dimensions of the second cover member 50 in the X-axis direction and in the Y-axis direction are longer than the dimensions of the first cover member 40 in the X-axis direction and in the Y-axis direction.

Figure 4:
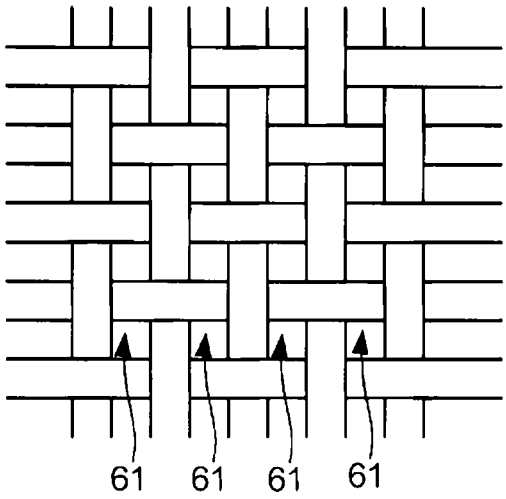
FIG. 4 is an enlarged view showing the surface of a third cover member.

The third cover members 60 are each the so-called metallic gauze formed by weaving metal wires into a sheet shape. The third cover members 60 each have a rectangular shape as viewed from the Z-axis direction. The dimensions of the third cover member 60 in the X-axis direction and in the Y-axis direction are longer than the dimensions of the second cover member 50 in the X-axis direction and in the Y-axis direction. The third cover member 60 has flexibility and can be bent and deflected. FIG. 4 is an enlarged view showing the surface of the third cover member 60. As shown in FIG. 4, the third cover member 60 has a plurality of meshes 61. Furthermore, it is preferable that the number of meshes 61 per inch (25.4 mm) is approximately 120 in the third cover member 60. With this configuration, a pointed object, such as a screw driver or a ball-point pen, cannot pass through the meshes 61.

(Structure of the Electrostatic Loudspeaker 1)

First, the structure of the main body 11 of the electrostatic loudspeaker 1 will be described.

The vibrating membrane 10 is disposed between the lower face of the elastic member 20U and the upper face of the elastic member 20L. An adhesive is applied to the vibrating member 10 in a width of several mm from the edges in the X-axis direction and from the edges in the Y-axis direction to the inside, and the vibrating membrane 10 is firmly bonded to the elastic member 20U and the elastic member 20L. In the portion to which no adhesive is applied, the vibrating membrane 10 is not firmly bonded to the elastic member 20U and the elastic member 20L. An adhesive is applied to the electrode 30U in a width of several mm from the edges in the X-axis direction and from the edges in the Y-axis direction to the inside, and the electrode 30U is firmly bonded to the upper face of the elastic member 20U. Furthermore, in the portion to which no adhesive is applied, the electrode 30U is not firmly bonded to the elastic member 20U. An adhesive is applied to the electrode 30L in a width of several mm from the edges in the X-axis direction and from the edges in the Y-axis direction to the inside, and the electrode 30L is firmly bonded to the lower face of the elastic member 20L. Moreover, in the portion to which no adhesive is applied, the electrode 30L is not firmly bonded to the elastic member 20L. The conductive membrane side of the electrode 30U makes contact with the elastic member 20U, and the conductive membrane side of the electrode 30L makes contact with the elastic member 20L. As described above, the main body 11 is formed of the vibrating membrane 10, the elastic members 20 and the electrodes 30.

Next, the structure of the cover members 12 of the electrostatic loudspeaker 1 will be described.

In the first cover member 40L, an adhesive is applied to an area having a width of several mm from the edges in the X-axis direction and from the edges in the Y-axis direction to the inside. This area to which the adhesive is applied is hereafter referred to as an adhesion area 401L. On the other hand, in the first cover member 40L, no adhesive is applied to the area excluding the adhesion area 401L, that is, the area having a rectangular shape as viewed from the Z-axis direction. The area to which no adhesive is applied is hereafter referred to as a non-adhesion area 402L. When the electrostatic loudspeaker 1 is formed, the main body 11 is disposed in the non-adhesion area 402L, and the first cover member 40U is firmly bonded to the adhesion area 401L. In other words, the main body 11 is in a state of being inserted while being covered with the first cover member 40U and the first cover member 40L. A state in which an object is inserted while being covered with other objects is hereafter referred to as a "contained" state.

In the second cover member 50L, an adhesive is applied to an area (adhesion area 501L) having a width of several mm from the edges in the X-axis direction and from the edges in the Y-axis direction to the inside. On the other hand, in the second cover member 50L, no adhesive is applied to the area excluding the adhesion area 501L, that is, the area (non-adhesion area 502L) having a rectangular shape as viewed from the Z-axis direction. Furthermore, when the electrostatic loudspeaker 1 is formed, the first cover members 40 containing the main body 11 are disposed in the non-adhesion area 502L, and the second cover member 50U is firmly bonded to the adhesion area 501L. In other words, the first cover members 40 containing the main body 11 are contained between the second cover member 50U and the second cover member 50L.

In the third cover member 60L, an adhesive is applied to an area (adhesion area 601L) having a width of several mm from the edges in the X-axis direction and from the edges in the Y-axis direction to the inside. On the other hand, in the third cover member 60L, no adhesive is applied to the area excluding the adhesion area 601L, that is, the area (non-adhesion area 602L) having a rectangular shape as viewed from the Z-axis direction. Furthermore, when the electrostatic loudspeaker 1 is formed, the second cover members 50 containing the main body 11 and the first cover members 40 are disposed in the non-adhesion area 602L, and the third cover member 60U is firmly bonded to the adhesion area 601L. In other words, the second cover members 50 containing the main body 11 and the first cover members 40 are contained between the third cover member 60U and the third cover member 60L.

(Electrical Configuration of the Electrostatic Loudspeaker 1)

Figure 5:
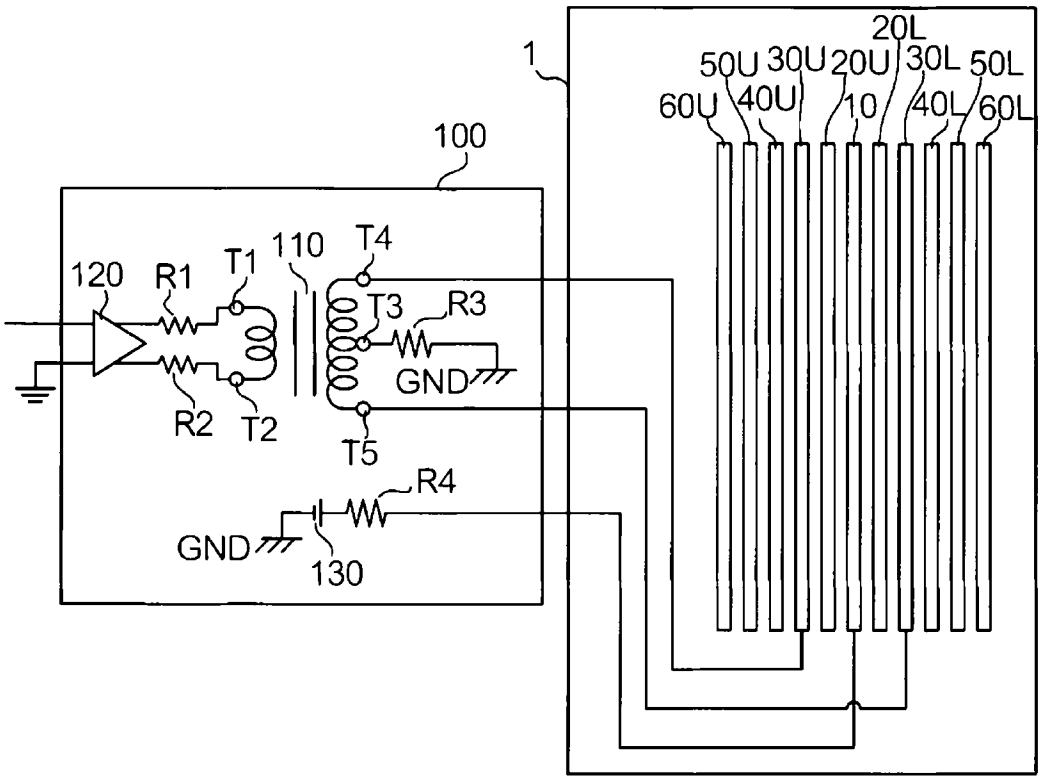
FIG. 5 is a view showing the electrical configuration of the electrostatic loudspeaker.

Next, the electrical configuration of the electrostatic loudspeaker 1 will be described. FIG. 5 is a view showing the electrical configuration of the electrostatic loudspeaker 1. A driver 100 is connected to the electrostatic loudspeaker 1. The driver 100 is equipped with a transformer 110, an amplifier 120, and a bias supply 130. The amplifier 120 amplifies an acoustic signal input to one terminal on the input side thereof and outputs the acoustic signal. Furthermore, the other terminal on the input side of the amplifier 120 is grounded. The terminal T1 on the input side of the transformer 110 is connected to the amplifier 120 via a resistor R1. The other terminal T2 on the input side of the transformer 110 is connected to the amplifier 120 via a resistor R2. The terminal T4 on the output side of the transformer 110 is connected to the conductive portion of the electrode 30U. The other terminal T5 on the output side of the transformer 110 is connected to the conductive portion of the electrode 30L. The middle point terminal T3 of the transformer 110 is connected to the ground GND having the reference potential of the drive circuit 100 via a resistor R3. One terminal of the bias supply 130 is connected to the vibrating membrane 10 via a resistor R4, and the other terminal is connected to the ground GND having the reference potential of the driver 100. Moreover, the bias supply 130 supplies a DC bias to the vibrating membrane 10. In this configuration, a voltage corresponding to the acoustic signal input to the amplifier 120 is applied across the electrodes 30, whereby the electrostatic loudspeaker 1 operates as a push-pull electrostatic loudspeaker.

(Operation of the Electrostatic Loudspeaker 1)

Next, the operation of the electrostatic loudspeaker 1 will be described. When an acoustic signal is input to the amplifier 120, a voltage corresponding to the input acoustic signal is applied across the electrode 30U and the electrode 30L from the transformer 110. When a potential difference occurs between the electrode 30U and the electrode 30L due to the applied voltage, an electrostatic force is exerted to the vibrating membrane 10 placed between the electrode 30U and the electrode 30L in a direction in which the vibrating membrane 10 is attracted to either the electrode 30U or the electrode 30L.

For example, it is assumed that an acoustic signal is input to the amplifier 120, an amplified acoustic signal is supplied to the transformer 110, a plus voltage is applied to the electrode 30U, and a minus voltage is applied to the electrode 30L. Since a plus voltage has been applied from the bias supply 130 to the vibrating membrane 10, the electrostatic attraction force between the vibrating membrane 10 and the electrode 30U to which the plus voltage is applied becomes weak; on the other hand, the electrostatic attraction force between the vibrating membrane 10 and the electrode 30L to which the minus voltage is applied becomes strong, whereby the vibrating membrane 10 is displaced toward the electrode 30L. Furthermore, it is assumed that an acoustic signal is input to the amplifier 120, an amplified acoustic signal is supplied to the transformer 110, a minus voltage is applied to the electrode 30U, and a plus voltage is applied to the electrode 30L. The electrostatic attraction force between the vibrating membrane 10 and the electrode 30L to which the plus voltage is applied becomes weak; on the other hand, the electrostatic attraction force between the vibrating membrane 10 and the electrode 30U to which the minus voltage is applied becomes strong, whereby the vibrating membrane 10 is displaced toward the electrode 30U. In this way, the vibrating membrane 10 is displaced toward the electrode 30U or toward the electrode 30L depending on the acoustic signal and the direction of the displacement changes sequentially, whereby vibration is generated and an acoustic wave corresponding to the vibration state (frequency, amplitude, and phase) is generated from the vibrating membrane 10. The generated acoustic wave passes through the elastic members 20, the electrodes 30, the first cover members 40, the second cover members 50 and the third cover members 60 and is radiated to the outside of the electrostatic loudspeaker 1.

According to the first embodiment, the members (hereafter referred to as live parts), such as the electrodes 30 and the vibrating membrane 10, involving a risk of electric shock are contained in the second cover members 50 having insulation property and waterproof property. Hence, there is a low possibility that the live parts are exposed to the outside or that liquid reaches the live parts. In other words, since the second cover members 50 contain the live parts, the possibility of electric shock to a human body can be lowered. Furthermore, since the second cover members 50 are contained in the third cover members 60 that do not allow a pointed object, such as a screw driver or a ball-point pen, to pass therethrough, there is a low possibility that the members are broken by such a pointed object or that the live parts are exposed to the outside and liquid reaches the live parts. Moreover, the synthetic resin film used to form the second cover members 50 has insulation property higher than that of a material, such as non-woven cloth or cloth. For this reason, the dimension (thickness) of the second cover members 50 in the Z-axis direction can be made smaller by forming the second cover members 50 using the synthetic resin than by forming them using non-woven cloth or cloth.

In addition, in the first embodiment, the first cover members 40 allow air and sound to pass therethrough and have a predetermined thickness, whereby the second cover members 50 and the electrodes 30 are spaced apart. In other words, the first cover members 40 can provide spaces through which the acoustic wave generated from the vibrating membrane 10 is transmitted. Hence, the degree of changing the acoustic characteristics (amplitude and phase) of the acoustic wave generated from the vibrating membrane 10 in the configuration of the electrostatic loudspeaker 1 is made lower than that in the configuration not equipped with the first cover members 40.

Furthermore, according to the first embodiment, since the electrostatic loudspeaker 1 is formed of members that can be deformed when a force is exerted thereto from the outside, the electrostatic loudspeaker 1 can be bent and deflected.

[Modifications]

The above-mentioned first embodiment is just one example of the embodiments according to the present invention. The present invention can be implemented in embodiments in which the following modifications are applied to the above-mentioned first embodiment. The following modifications may be appropriately combined and implemented as necessary.

(Modification 1)

The vibrating membrane is not limited to a membrane obtained by evaporating a conductive metal on one face of the film, but may be a membrane obtained by evaporating a conductive metal on both faces of the film. In addition, the vibrating membrane is not limited to be made of PET or PP, but may be a membrane obtained by evaporating a conductive metal on a film of another synthetic resin.

(Modification 2)

The elastic member is not limited to be made of non-woven cloth, but may be a member having insulation property, acoustic transmission property, and elasticity; for example, the elastic member may be a member obtained by heating and compressing cotton, a member made of woven cloth, or a member obtained by forming a synthetic resin into a spongy shape.

(Modification 3)

The electrode is not limited to an electrode obtained by evaporating a conductive metal on one face of the film, but may be an electrode obtained by evaporating a conductive metal on both faces of the film. In addition, the electrode is not limited to be made of the film, but may be made of a material having conductibility, acoustic transmission property, and elasticity; for example, the electrode may be made of cloth woven with conductive threads.

(Modification 4)

The first cover member is not limited to be made of non-woven cloth, but may be made of a material allowing air and sound to pass therethrough and having elasticity; for example, the first cover member may be a member obtained by heating and compressing cotton or a member made of woven cloth or resin mesh.

The third cover member is not limited to be made of metallic gauge, but may be a member allowing air and sound to pass therethrough and having elasticity; for example, the third cover member may be a member obtained by heating and compressing cotton or a member made of woven cloth or resin mesh.

The second cover member may have a sheet-like configuration in which a film of a synthetic resin having insulation property and flexibility, such as PET or PP, is used as a base material and a conductive metal (for example, aluminum) is evaporated on the faces of the film to form conductive membranes. Second cover members 50*a* formed as described above have waterproof property and the steam passing rate thereof becomes low.

Figure 6:
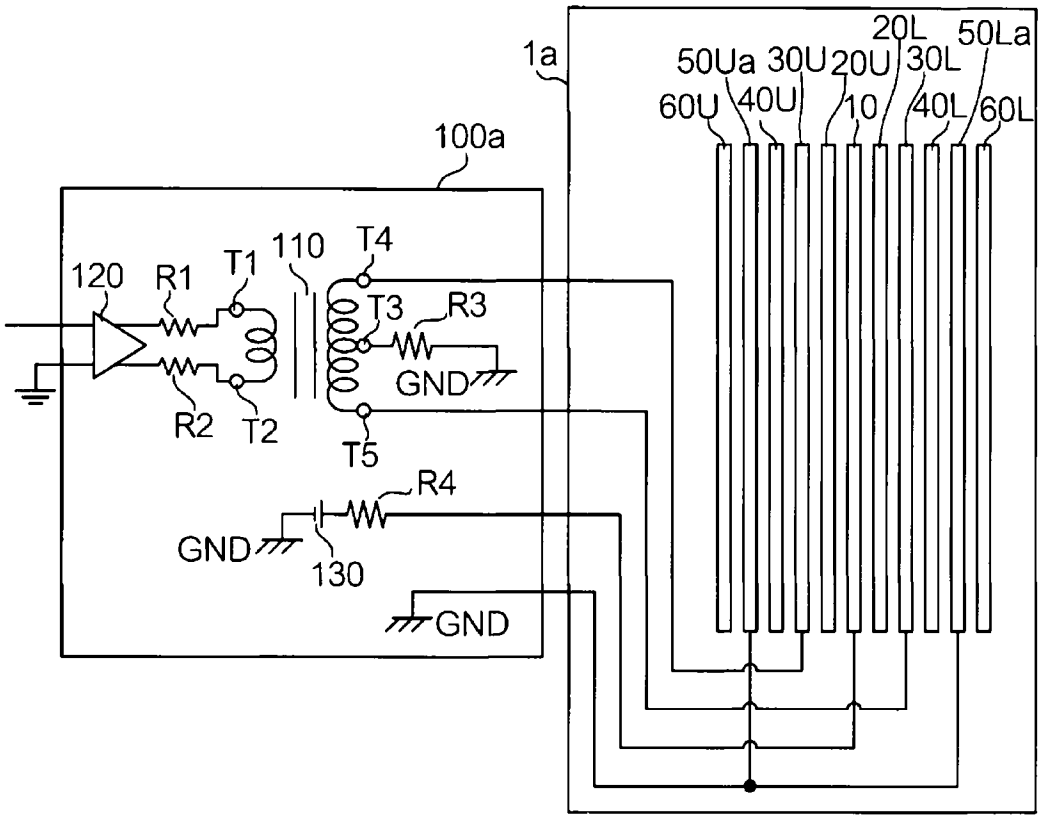
FIG. 6 is a view showing the electrical configuration of an electrostatic loudspeaker according to a modification of the first embodiment of the present invention.

In the case that the second cover members have conductivity, the electrostatic loudspeaker may be configured as described below. FIG. 6 is a view showing the electrical configuration of an electrostatic loudspeaker 1*a* according to a modification of the first embodiment. In the descriptions referring to FIG. 6, the descriptions of the respective members common to those shown in FIG. 5 are omitted. As shown in the figure, a driver 100*a* is connected to the electrostatic loudspeaker 1*a*. At this time, a second cover member 50Ua and a second cover member 50La are connected to the ground GND having the reference potential of the drive circuit 100*a*. In other words, since the second cover member 50Ua and the second cover member 50La have the same potential, no current is supplied. Hence, even if a human body touches the second cover members 50, no electric shock is received.

(Modification 5)

In the above-mentioned first embodiment, the edges of the cover members 12 are firmly bonded to each other using an adhesive applied to the edges of the cover members 12; however, the method for performing the firm bonding and the area in which the firm bonding is performed are not limited to those described above. For example, FIGS. 7, 8, and 9 are views showing the examples of areas to which an adhesive is applied according to this modification.

Figure 7:
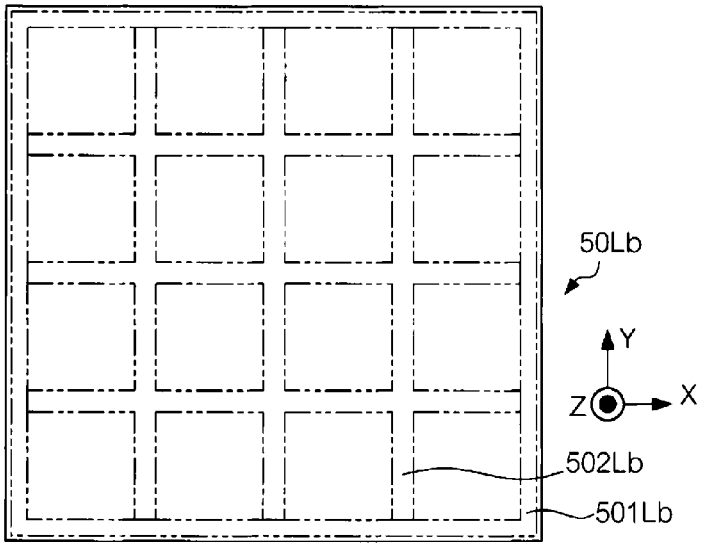
FIG. 7 is a view showing areas to which an adhesive is applied according to a modification of the first embodiment of the present invention.

In FIG. 7, an adhesive is applied to an area (first adhesion area 501Lb) having a width of several mm from the edges of a second cover member 50Lb in the X-axis direction and from the edges thereof in the Y-axis direction to the inside and to a grid-like area (second adhesion area 502Lb) having grids at predetermined intervals in the X-axis direction and in the Y-axis direction. It is preferable that the predetermined interval is approximately 20 mm, for example. On the other hand, in the second cover member 50Lb, no adhesive is applied to the areas excluding the first adhesion area 501Lb and the second adhesion area 502Lb. When an electrostatic loudspeaker is formed, part of the first cover members containing the main body is firmly bonded to the second adhesion area 502Lb, and the second cover member 50U is firmly bonded to the first adhesion area 501Lb.

Figure 8:
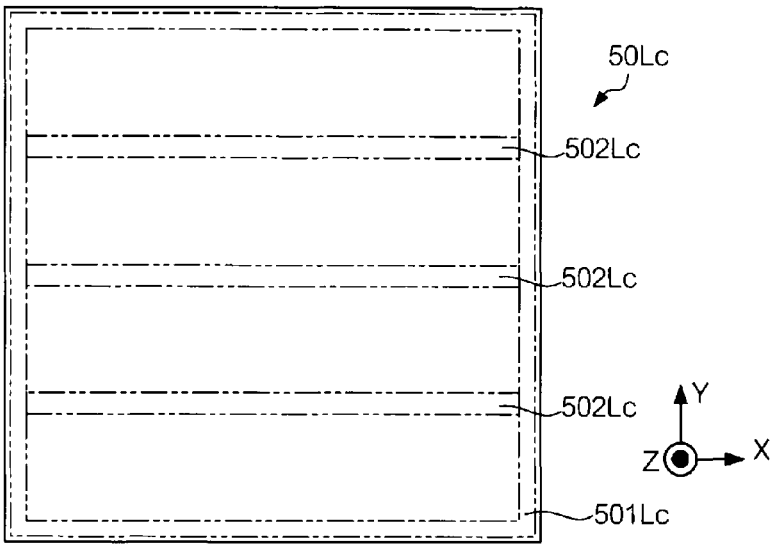
FIG. 8 is a view showing areas to which an adhesive is applied according to a modification of the first embodiment of the present invention.

In FIG. 8, an adhesive is applied to an area (first adhesion area 501Lc) having a width of several mm from the edges of a second cover member 50Lc in the X-axis direction and from the edges thereof in the Y-axis direction to the inside and to a plurality of rectangular areas (second adhesion areas 502Lc) spaced at predetermined intervals in the Y-axis direction. It is preferable that the predetermined interval is approximately 20 mm, for example. On the other hand, in the second cover member 50Lc, no adhesive is applied to the areas excluding the first adhesion area 501Lc and the second adhesion areas 502Lc. When an electrostatic loudspeaker is formed, part of the first cover members containing the main body is firmly bonded to the second adhesion areas 502Lc, and the second cover member 50U is firmly bonded to the first adhesion area 501Lc.

Figure 9:
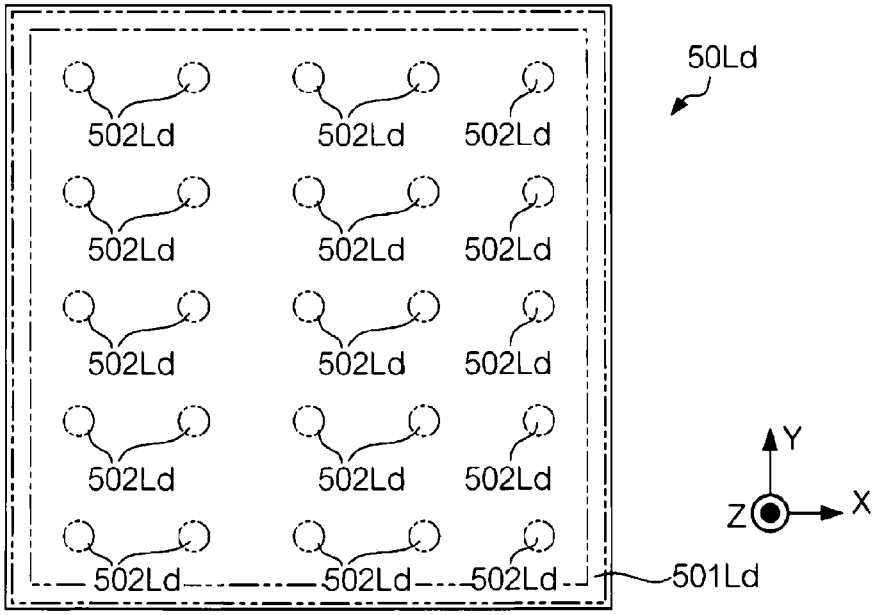
FIG. 9 is a view showing areas to which an adhesive is applied according to a modification of the first embodiment of the present invention.

In FIG. 9, an adhesive is applied to an area (first adhesion area 501Ld) having a width of several mm from the edges of a second cover member 50Ld in the X-axis direction and from the edges thereof in the Y-axis direction to the inside and to a plurality of dot-like areas (second adhesion areas 502Ld) disposed so as to be spaced at predetermined intervals in the X-axis direction and in the Y-axis direction. It is preferable that the predetermined interval is approximately 20 mm, for example. On the other hand, on the surface of the second cover member 50Ld, no adhesive is applied to the area excluding the first adhesion area 501Ld and the second adhesion areas 502Ld. When an electrostatic loudspeaker is formed, part of the first cover members containing the main body is firmly bonded to the second adhesion areas 502Ld, and the second cover member 50U is firmly bonded to the first adhesion area 501Ld.

Although only the second cover member is shown in each of FIGS. 7, 8, and 9, an adhesive may also be applied to similar areas in the cases of the first cover member and the third cover member.

Since the members to which an adhesive has been applied as shown in FIGS. 7, 8, and 9 are firmly bonded to each other, the members adjacent to each other are not displaced relatively to each other. In addition, since partial areas of the respective members are firmly bonded, the degree of changing the acoustic characteristics (amplitude and phase) of the acoustic wave generated from the vibrating membrane is made lower than that in the case that the entire areas of the respective members are firmly bonded.

In the case that the first cover member is formed of resin mesh, the second cover member may be firmly bonded using the adhesive applied to the first cover member.

Figure 10:
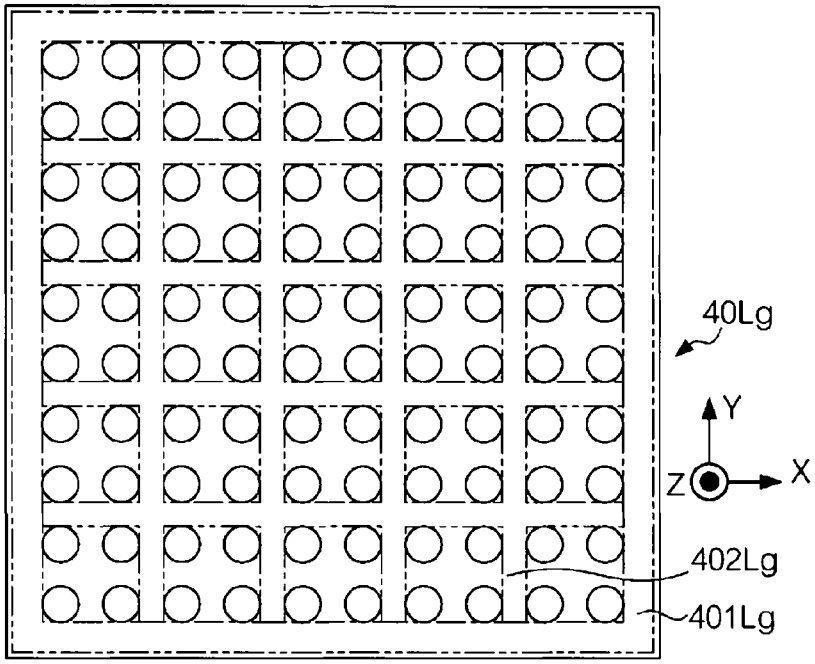
FIG. 10 is a view illustrating the areas of a first cover member to which an adhesive is applied according to the modifications shown in FIGS. 7, 8 and 9.

FIG. 10 is a view illustrating the areas of the first cover member to which an adhesive is applied according to this modification.

In a first cover member 40Lg formed of resin mesh, an adhesive is applied to an area (first adhesion area 401Lg) having a width of several mm from the edges in the X-axis direction and from the edges thereof in the Y-axis direction to the inside and to a grid-like area (second adhesion area 402Lg) having grids at predetermined intervals in the X-axis direction and in the Y-axis direction. It is preferable that the predetermined interval is approximately 20 mm, for example. Then, the surface of the second cover member is firmly bonded to the first adhesion area 401Lg and the second adhesion area 402Lg. The second cover member and the third cover member should only be firmly bonded by applying an adhesive to the adhesion areas shown in FIGS. 3, 7, 8, and 9.

In the electrostatic loudspeaker, the members adjacent to each other may be firmly bonded using a double-faced adhesive tape or a hot-melt adhesive, instead of an adhesive. In the case that a double-faced adhesive tape is used to perform firm bonding, it is preferable to use a configuration in which firm bonding is performed at portions having a constant width from the edges or a configuration in which firm bonding is performed in a grid shape, instead of firmly bonding the entire faces of the members adjacent to each other. Furthermore, in the case that firm bonding is performed using a hot-melt adhesive, it is preferable to perform firm bonding at portions having a constant width from the edges, instead of firmly bonding the entire faces of the members adjacent to each other.

(Modification 6)

In the above-mentioned first embodiment, the cover members are equipped with the first cover members, the second cover members, and the third cover members; however, the cover members may be further equipped with other members.

Figure 11:
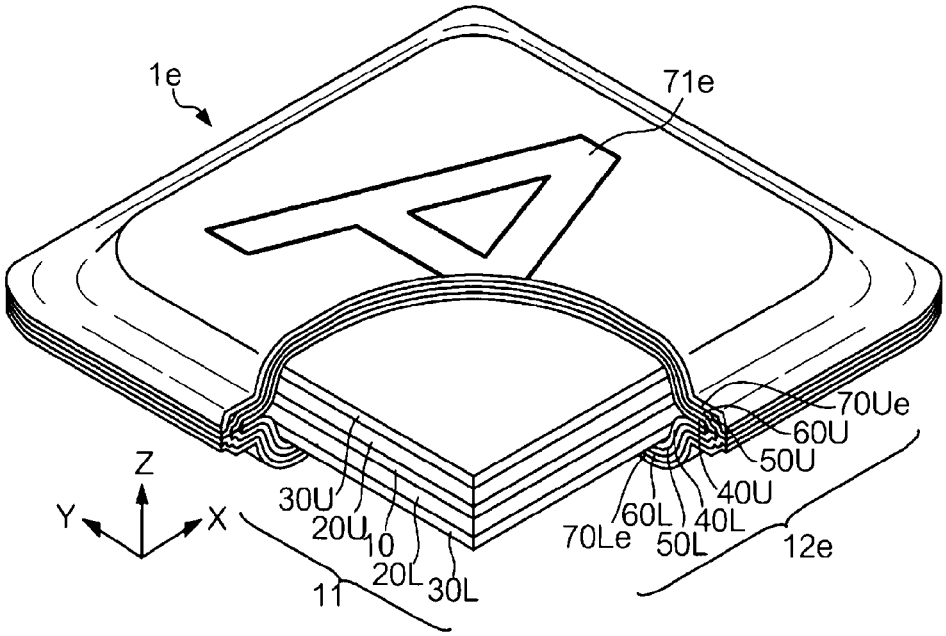
FIG. 11 is an external view showing an electrostatic loudspeaker according to a modification of the first embodiment of the present invention.
Figure 12:
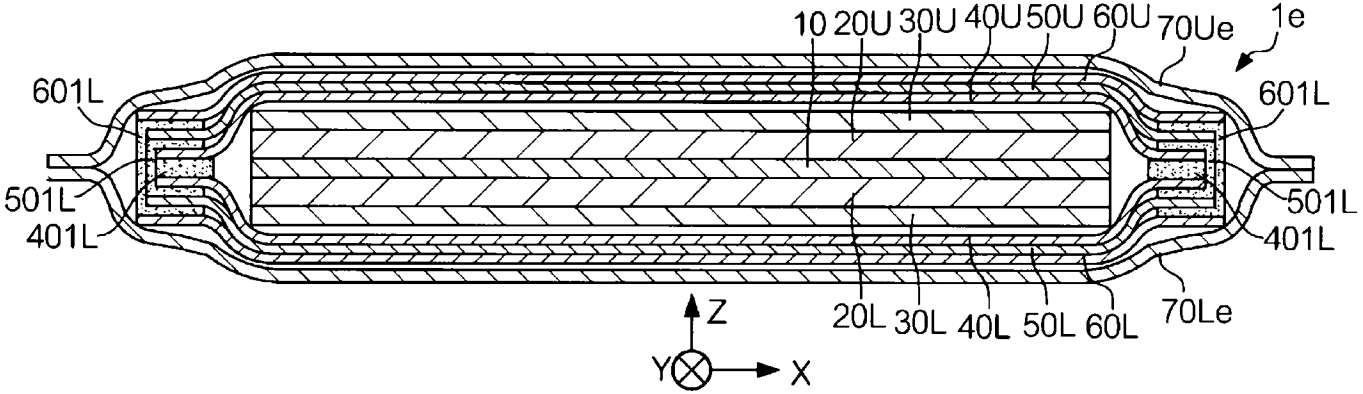
FIG. 12 is a sectional view showing the electrostatic loudspeaker according to the modification of the first embodiment of the present invention.

FIG. 11 is an external view showing an electrostatic loudspeaker 1*e* according to a modification of the first embodiment of the present invention, and FIG. 12 is a sectional view showing the electrostatic loudspeaker 1*e* according to the modification of the first embodiment of the present invention. The cover members 12*e* of the electrostatic loudspeaker 1*e* are equipped with the first cover members 40U and 40L, the second cover members 50U and 50L, the third cover members 60U and 60L, and fourth cover members 70Ue and 70Le. The electrostatic loudspeaker 1*e* shown in FIG. 11 is configured so that the fourth cover members 70Ue and 70Le contain the electrostatic loudspeaker 1 shown in FIG. 1. Hence, in the description of the electrostatic loudspeaker 1*e* shown in FIG. 11, the descriptions of the members and configurations common to those used in the electrostatic loudspeaker 1 shown in FIG. 1 are omitted.

The fourth cover members 70Ue and 70Le are made of woven cloth and have acoustic transmission property and flexibility. Furthermore, the fourth cover members 70Ue and 70Le have a rectangular shape as viewed from the Z-axis direction, and the dimensions thereof in the X-axis direction and in the Y-axis direction are the same. The dimensions of the fourth cover members 70Ue and 70Le in the X-axis direction and in the Y-axis direction are longer than the dimensions of the third cover members 60 in the X-axis direction and in the Y-axis direction. Moreover, images, such as letters, pictures, and photographs, can be formed on the surface of the fourth cover members 70Ue and 70Le. In this modification, an image 71*e* is printed on the upper face of the fourth cover member 70Ue. In the electrostatic loudspeaker 1*e* configured as described above, the fourth cover members 70Ue and 70Le on which images are printed are placed on the outermost sides. Hence, an acoustic wave relating to the images printed on the surfaces of the fourth cover members 70Ue and 70Le can be radiated from the surfaces of the fourth cover members 70Ue and 70Le. The fourth cover members are not limited to be made of woven cloth, but may be made of paper having acoustic transmission property and flexibility. Furthermore, the paper for use as the fourth cover members may be provided with through-holes passing through from the front face to the back face to improve acoustic transmission property.

(Modification 7)

Figure 13:
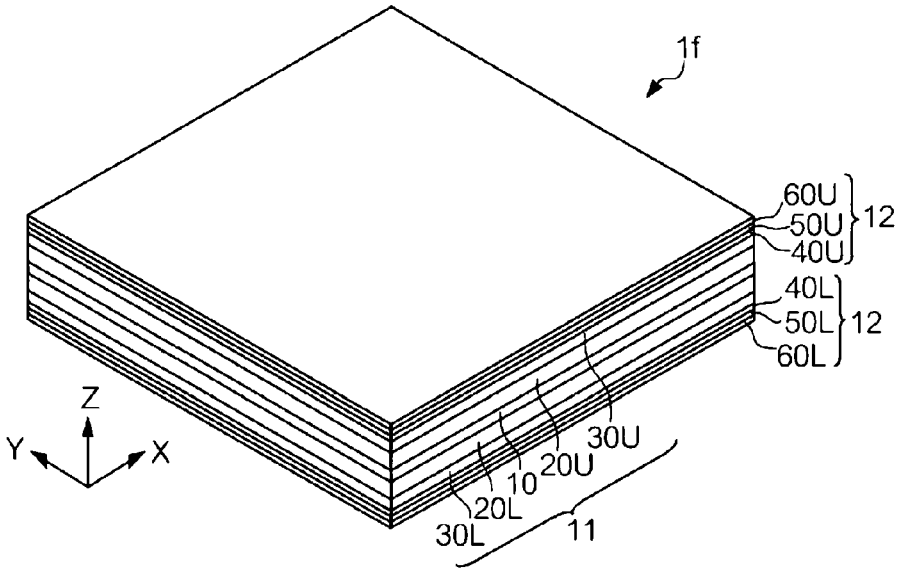
FIG. 13 is an external view showing an electrostatic loudspeaker according to a modification of the first embodiment of the present invention.

In the above-mentioned first embodiment, the main body is contained in the cover members. However, the cover members may be firmly bonded to the electrodes of the main body. FIG. 13 is an external view showing an electrostatic loudspeaker if according to a modification of the first embodiment of the present invention. The descriptions of the common points between the electrostatic loudspeaker 1 and the electrostatic loudspeaker 1*f* are omitted, and only the different points are described.

The first cover members 40, the second cover members 50, and the third cover members 60 have a rectangular shape as viewed from the Z-axis direction, and the dimensions thereof in the X-axis direction and in the Y-axis direction are the same as the dimensions of the electrodes 30 in the X-axis direction and in the Y-axis direction. The first cover member 40U to which an adhesive is applied to the edges thereof in the X-axis direction and in the Y-axis direction is firmly bonded to the upper face of the electrode 30U, and the first cover member 40L to which an adhesive is applied to the edges thereof in the X-axis direction and in the Y-axis direction is firmly bonded to the lower face of the electrode 30L. The second cover member 50U to which an adhesive is applied to the edges thereof in the X-axis direction and in the Y-axis direction is firmly bonded to the upper face of the first cover member 40U, and the second cover member 50L to which an adhesive is applied to the edges thereof in the X-axis direction and in the Y-axis direction is firmly bonded to the lower face of the first cover member 40L. The third cover member 60U to which an adhesive is applied to the edges thereof in the X-axis direction and in the Y-axis direction is firmly bonded to the upper face of the second cover member 50U, and the third cover member 60L to which an adhesive is applied to the edges thereof in the X-axis direction and in the Y-axis direction is firmly bonded to the lower face of the second cover member 50L. Between the respective members, the portion located inside the portion to which the adhesive has been applied is in a state of not being firmly bonded.

Even in this modification, the surfaces of the electrodes 30 involving a risk of electric shock are covered with the second cover members 50 having insulation property, whereby the possibility of electric shock to a human body can be lowered.

(Modification 8)

In the above-mentioned first embodiment, the so-called push-pull electrostatic loudspeaker equipped with two electrodes and one vibrating membrane is used; however, it may be possible to use the so-called single electrostatic loudspeaker equipped with one electrode and one vibrating membrane. The point is that a configuration should only be obtained in which an electric field is formed depending on an acoustic signal, a vibrating membrane charged is displaced by a force exerted from this electric field, the direction of the displacement is changed sequentially to generate vibration, and sound corresponding to the vibration state (frequency, amplitude, and phase) is generated from the vibrating membrane.

(Modification 9)

In the above-mentioned first embodiment, the shapes of the respective members constituting the electrostatic loudspeaker are not limited to a rectangular shape, but other shapes, such as a polygonal shape, a circular shape, and an elliptic shape, may be used.

(Modification 10)

In the above-mentioned first embodiment, the first cover member 40U and the first cover member 40L are used to contain the main body 11; however, one first cover member may be used to contain the main body. More specifically, it may be possible that in a state in which the main body is entirely covered with one first cover member and the main body is disposed in the space formed between the first cover members, the edges of the first cover members are firmly bonded to each other.

Furthermore, as in the case of the first cover members, it may be possible that in a state in which the first cover members containing the main body are entirely covered with one second cover member and the first cover members containing the main body are disposed in the space formed between the second cover members, the edges of the second cover members are firmly bonded to each other.

Moreover, as in the case of the first cover members, it may be possible that in a state in which the second cover members containing the first cover members are entirely covered with one third cover member and the second cover members containing the first cover members are disposed in the space formed between the third cover members, the edges of the third cover members are firmly bonded to each other.

Second Embodiment

Figure 14:
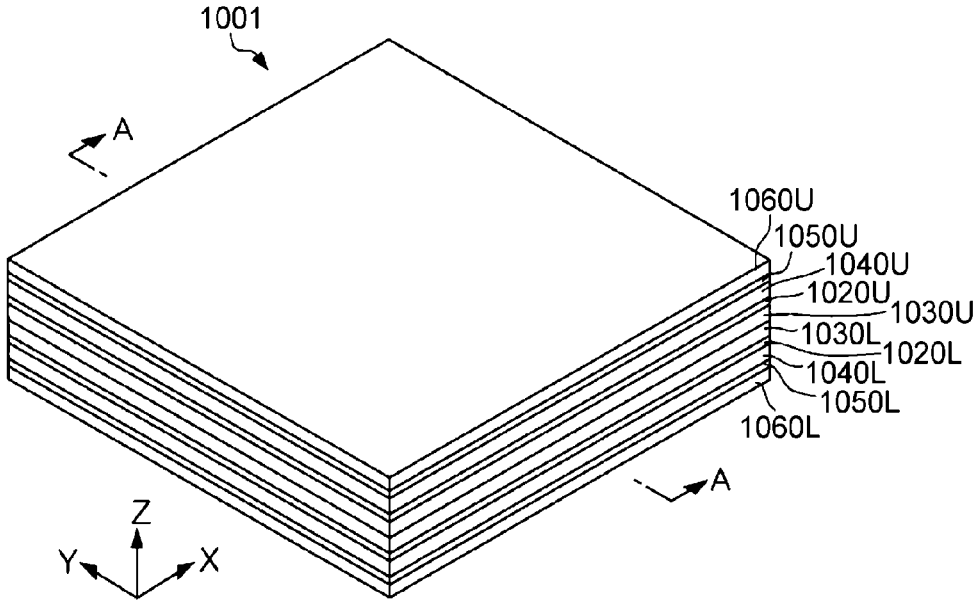
FIG. 14 is an external view showing an electrostatic loudspeaker according to a second embodiment of the present invention.
Figure 15:
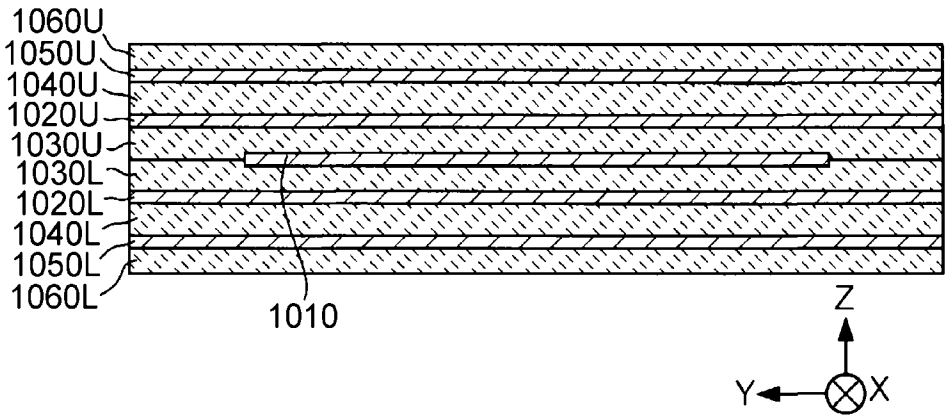
FIG. 15 is a sectional view taken on line A-A of FIG. 14.
Figure 16:
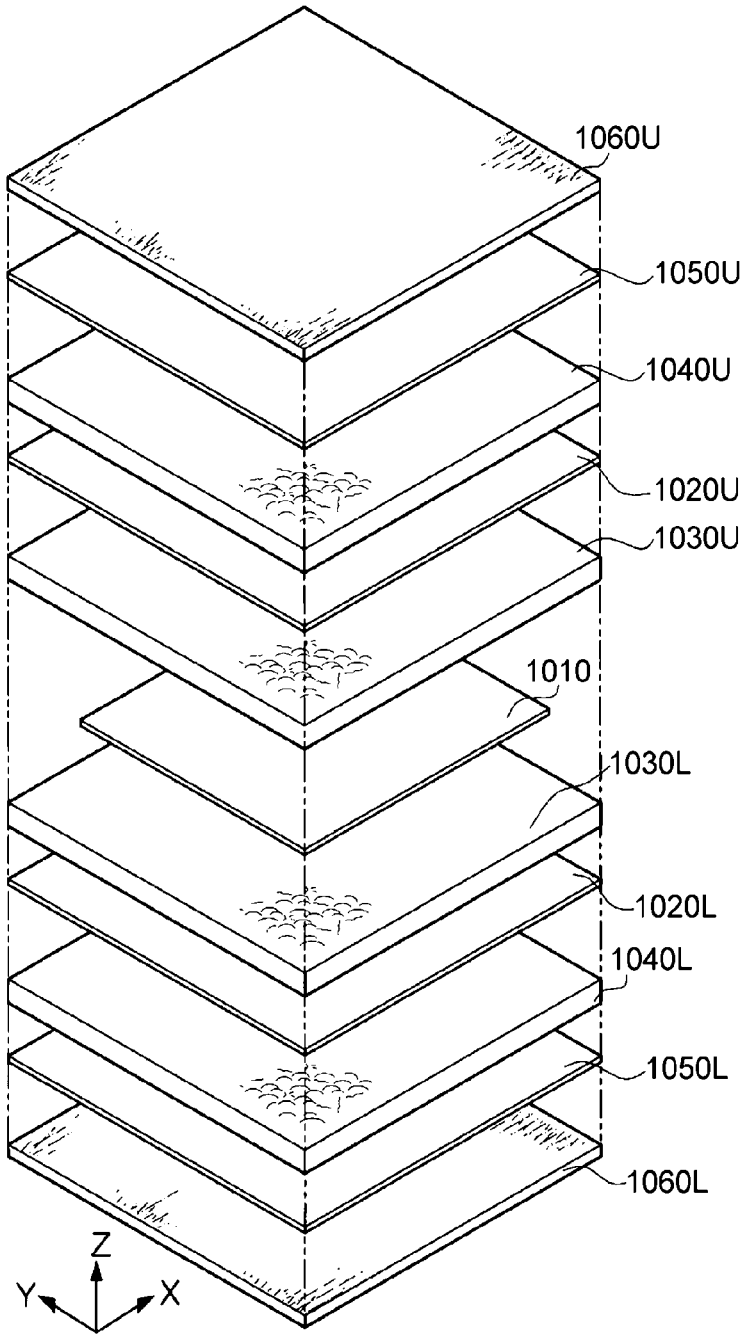
FIG. 16 is an exploded view showing the electrostatic loudspeaker.
Figure 17:
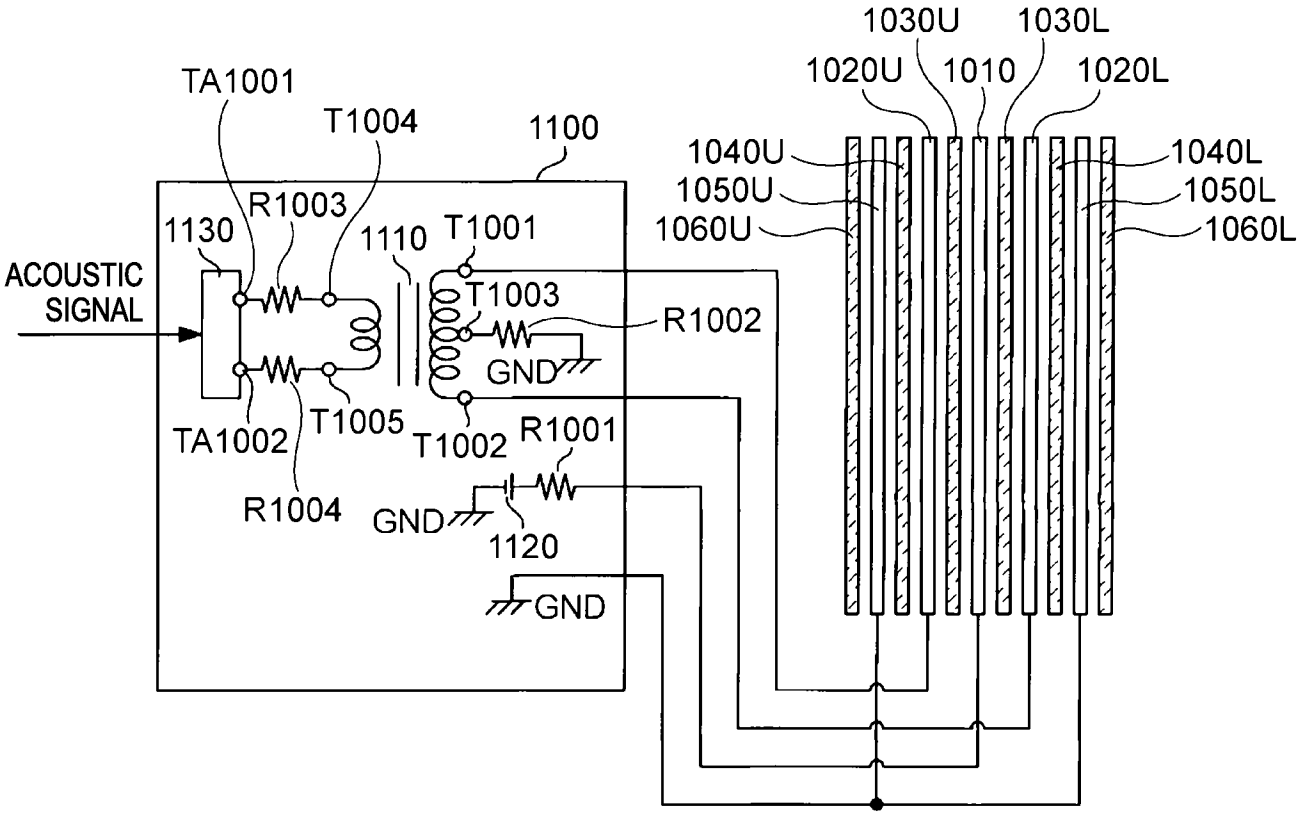
FIG. 17 is a view showing the electrical configuration of the electrostatic loudspeaker.

FIG. 14 is an external view showing an electrostatic loudspeaker 1001 according to a second embodiment of the present invention, and FIG. 15 is a sectional view showing the electrostatic loudspeaker 1001, taken on line A-A of FIG. 14. In addition, FIG. 16 is an exploded view showing the electrostatic loudspeaker 1001, and FIG. 17 is a view showing the electrical configuration of the electrostatic loudspeaker 1001. In these figures, the X, Y, and Z axes perpendicular to one another indicate directions; it is assumed that the left-right direction as viewed from the front of the electrostatic loudspeaker 1001 is the X-axis direction, that the depth direction is the Y-axis direction, and that the height direction is the Z-axis direction. Besides, it is assumed that "·" written in "o" in each figure means an arrow directed from the back to the front of the figure. Moreover, "×" written in "o" in each figure means an arrow directed from the front to the back of the figure.

As shown in the figures, the electrostatic loudspeaker 1001 is equipped with a vibrating member 1010, electrodes 1020U and 1020L, elastic members 1030U and 1030L, spacers 1040U and 1040L, covers 1050U and 1050L, and protection members 1060U and 1060L. In the second embodiment, the configurations of the electrodes 1020U and 1020L are the same, and the configurations of the elastic members 1030U and 1030L are the same. Hence, in the case that it is not particularly necessary to distinguish between the two in these members, the descriptions of, for example, "L" and "U" are omitted. Furthermore, the configurations of the spacers 1040U and 1040L are the same, the configurations of the covers 1050U and 1050L are the same, and the configurations of the protection members 1060U and 1060L are the same. Hence, in the case that it is not particularly necessary to distinguish between the two in these members, the descriptions of, for example, "L" and "U" are omitted. Still further, the dimensions of the respective components, such as the vibrating member and the electrodes, shown in the figures are made different from the actual dimensions thereof so that the shapes of the components can be understood easily.

(Configurations of the Respective Components of the Electrostatic Loudspeaker 1001)

First, various sections constituting the electrostatic loudspeaker 1001 will be described. The vibrating member 1010 having a rectangular shape as viewed from a point on the Z-axis has a sheet-like configuration in which a film (insulation layer) of a synthetic resin having insulation property and flexibility, such as PET (polyethylene terephthalate) or PP (polypropylene), is used as a base material and a conductive metal is evaporated on one face of the film to form a conductive membrane (conductive layer). In this second embodiment, although the conductive membrane is formed on one face of the film, it may be formed on both sides of the film.

In the second embodiment, the elastic member 1030 is made of non-woven cloth, does not conduct electricity and allows air and sound to pass therethrough, and its shape is rectangular as viewed from a point on the Z-axis. The elastic member 1030 has elasticity, and it is deformed when an external force is applied thereto and returns to its original shape when the external force is removed. The elastic member 1030 should only be a member having insulation property, acoustic transmission property, and elasticity; for example, the elastic member may be a member obtained by heating and compressing cotton, a member made of woven cloth, or a member obtained by forming a synthetic resin into a spongy shape. In the second embodiment, the length of the elastic member 1030 in the X-axis direction is longer than the length of the vibrating member 1010 in the X-axis direction, and the length of the elastic member 1030 in the Y-axis direction is longer than the length of the vibrating member 1010 in the Y-axis direction.

In the second embodiment, the spacer 1040 is made of non-woven cloth, does not conduct electricity and allows air and sound to pass therethrough, and its shape is rectangular as viewed from a point on the Z-axis. The elastic member 1030 has elasticity. In the second embodiment, the spacer 1040 is made of the same material as that of the elastic member 1030; however, the spacer is not required to have elasticity, provided that it does not conduct electricity and allows air and sound to pass therethrough. Furthermore, in the second embodiment, the lengths of the spacer 1040 in the X-axis direction and in the Y-axis direction are the same as the lengths of the elastic member 1030.

The electrode 1020 has a configuration in which a film (insulation layer) of a synthetic resin having insulation property, such as PET or PP, is used as a base material and a conductive metal is evaporated on one face of the film to form a conductive membrane (conductive layer). The electrode 1020 has a rectangular shape as viewed from a point on the Z-axis and has a plurality of through-holes passing through from the front face to the back face and allows air and sound to pass therethrough. These holes are not shown in the figures. In the second embodiment, the lengths of the electrode 1020 in the X-axis direction and in the Y-axis direction are the same as those of the elastic member 1030.

The cover 1050 has a configuration in which a film (insulation layer) of a synthetic resin having insulation property, such as PET or PP, is used as a base material and a conductive metal (for example, aluminum) is evaporated on one entire face of the insulation layer to form a conductive membrane (conductive layer). In the second embodiment, the lengths of the cover 1050 in the X-axis direction and in the Y-axis direction are the same as those of the elastic member 1030. Furthermore, it is preferable that the insulation layer of the cover 1050 has waterproof property and is low in moisture permeability and air permeability. In the second embodiment, although the conductive membrane is formed on one face of the cover 1050, it may be formed on both faces of the cover 1050.

The protection member 1060 is made of cloth having insulation property. The protection member 1060 has a rectangular shape as viewed from a point on the Z-axis and allows air and sound to pass therethrough. In the second embodiment, the lengths of the protection member 1060 in the X-axis direction and in the Y-axis direction are the same as those of the elastic member 1030.

(Structure of the Electrostatic Loudspeaker 1001)

Next, the structure of the electrostatic loudspeaker 1001 will be described. In the electrostatic loudspeaker 1001, the vibrating member 1010 is disposed between the lower face of the elastic member 1030U and the upper face of the elastic member 1030L. In the vibrating member 1010, an adhesive is applied in a width of several mm from the edges in the left-right direction and from the edges in the depth direction to the inside, the vibrating member 1010 is bonded to the elastic member 1030U and the elastic member 1030L, and in the inside of the portion to which the adhesive is applied, the vibrating member 1010 is in a state of not being firmly bonded to the elastic member 1030U and the elastic member 1030L.

The electrode 1020U is bonded to the upper face of the elastic member 1030U. Furthermore, the electrode 1020L is bonded to the lower face of the elastic member 1030L. In the electrode 1020U, an adhesive is applied in a width of several mm from the edges in the left-right direction and from the edges in the depth direction to the inside, and the electrode 1020U is bonded to the elastic member 1030U; and in the electrode 1020L, an adhesive is applied in a width of several mm from the edges in the left-right direction and from the edges in the depth direction to the inside, and the electrode 1020L is bonded to the elastic member 1030L. In the inside of the portion to which the adhesive is applied, the electrode 1020 is in a state of not being firmly bonded to the elastic member 1030. Moreover, the conductive membrane side of the electrode 1020U makes contact with the elastic member 1030U, and the conductive membrane side of the electrode 1020L makes contact with the elastic member 1030L.

The spacer 1040U is bonded to the upper face of the electrode 1020U. Furthermore, the spacer 1040L is bonded to the lower face of the electrode 1020L. In the spacer 1040U, an adhesive is applied in a width of several mm from the edges in the left-right direction and from the edges in the depth direction to the inside and the spacer 1040U is bonded to the electrode 1020U; and in the spacer 1040L, an adhesive is applied in a width of several mm from the edges in the left-right direction and from the edges in the depth direction to the inside and the spacer 1040L is bonded to the electrode 1020L. In the inside of the portion to which the adhesive is applied, the spacer 1040 is in a state of not being firmly bonded to the electrode 1020.

The cover 1050U is bonded to the upper face of the spacer 1040U so that the base material made of a synthetic resin makes contact with the spacer 1040U. Furthermore, the cover 1050L is bonded to the lower face of the spacer 1040L so that the base material made of a synthetic resin makes contact with the spacer 1040L. In the cover 1050U, an adhesive is applied in a width of several mm from the edges in the left-right direction and from the edges in the depth direction to the inside, and the cover 1050U is bonded to the spacer 1040U; and in the cover 1050L, an adhesive is applied in a width of several mm from the edges in the left-right direction and from the edges in the depth direction to the inside, and the cover 1050L is bonded to the spacer 1040L. In the inside of the portion to which the adhesive is applied, the cover 1050 is in a state of not being firmly bonded to the spacer 1040. Furthermore, it is preferable that the thickness of the cover 1050 is approximately 10 μm. In the case that the thickness has this value, even if the cover 1050 is disposed, the acoustic pressure of the sound generated by the vibrating member 1010 does not become excessively lower than that in the case that the cover 1050 is not disposed. In the second embodiment, the cover 1050 is bonded to the spacer 1040 so that the synthetic resin film thereof makes contact with the spacer 1040; however, the cover 1050 may be bonded to the spacer 1040 so that the conductive membrane of the cover 1050 makes contact with the spacer 1040.

The protection member 1060U is bonded to the upper face of the cover 1050U. Furthermore, the protection member 1060L is bonded to the lower face of the cover 1050L. In the protection member 1060U, an adhesive is applied in a width of several mm from the edges in the left-right direction and from the edges in the depth direction to the inside, and the protection members 1060U is bonded to the cover 1050U; and in the protection member 1060L, the adhesive is applied in a width of several mm from the edges in the left-right direction and from the edges in the depth direction to the inside, and the protection member 1060L is bonded to the cover 1050L. In the inside of the portion to which the adhesive is applied, the protection member 1060 is in a state of not being firmly bonded to the cover 1050.

(Electrical Configuration of the Electrostatic Loudspeaker 1001)

Next, the electrical configuration of the electrostatic loudspeaker 1001 will be described. As shown in FIG. 17, to the electrostatic loudspeaker 1001, a drive circuit 1100 equipped with an amplifier 1130 to which an acoustic signal representing sound is input from the outside, a transformer 1110, and a bias supply 1120 for supplying a DC bias to the vibrating member 1010 is connected.

The electrode 1020U is connected to one secondary terminal T1001 of the transformer 1110, and the electrode 1020L is connected to the other secondary terminal T1002 of the transformer 1110. Furthermore, the vibrating member 1010 is connected to the bias supply 1120 via a resistor R1001. The middle point terminal T1003 of the transformer 1110 is connected to the ground GND having the reference potential of the drive circuit 1100 via a resistor R1002.

An acoustic signal is input to the amplifier 1130. The amplifier 1130 amplifies the input acoustic signal and outputs an amplified acoustic signal. The amplifier 1130 has terminals TA1001 and TA1002 for outputting the acoustic signal; the terminal TA1001 is connected to one primary side terminal T1004 of the transformer 1110 via a resistor R1003, and the terminal TA1002 is connected to the other primary side terminal T1005 of the transformer 1110 via a resistor R1004. The conductive membrane of the cover 1050U and the conductive membrane of the cover 1050L are electrically connected to each other, and both are connected to the ground GND of the drive circuit 1100.

(Operation of the Electrostatic Loudspeaker 1001)

Next, the operation of the electrostatic loudspeaker 1001 will be described. When an AC acoustic signal is input to the amplifier 1130, the input acoustic signal is amplified and supplied to the primary side of the transformer 1110. Then, when a potential difference is generated between the electrode 1020U and the electrode 1020L by the supplied voltage, an electrostatic force is exerted to the vibrating member 1010 placed between the electrode 1020U and the electrode 1020L in a direction in which the vibrating member 1010 is attracted to either the electrode 1020U or the electrode 1020L.

More specifically, the polarity of the second acoustic signal output from the terminal T1002 is opposite to that of the first acoustic signal output from the terminal T1001. When a plus acoustic signal is output from the terminal T1001 and a minus acoustic signal is output from the terminal T1002, a plus voltage is applied to the electrode 1020U and a minus voltage is applied to the electrode 1020L. Since a plus voltage has been applied from the bias supply 1120 to the vibrating member 1010, the electrostatic attraction force between the vibrating member 1010 and the electrode 1020U to which the plus voltage is applied becomes weak; on the other hand, the electrostatic attraction force between the vibrating member 1010 and the electrode 1020L to which the minus voltage is applied becomes strong, whereby a suction force is exerted toward the electrode 1020L depending on the difference between the electrostatic attraction forces applied to the vibrating member 1010, and the vibrating member 1010 is displaced toward the electrode 1020L (in a direction opposite to the Z-axis direction).

Furthermore, when a minus first acoustic signal is output from the terminal T1001 and a plus second acoustic signal is output from the terminal T1002, a minus voltage is applied to the electrode 1020U and a plus voltage is applied to the electrode 1020L. Since a plus voltage has been applied from the bias supply 1120 to the vibrating member 1010, the electrostatic attraction force between the vibrating member 1010 and the electrode 1020L to which the plus voltage is applied becomes weak; on the other hand, the electrostatic attraction force between the vibrating member 1010 and the electrode 1020U to which the minus voltage is applied becomes strong, whereby the vibrating member 1010 is displaced toward the electrode 1020U (in the Z-axis direction).

In this way, the vibrating member 1010 is displaced (deflected) in the positive direction of the Z-axis and the negative direction of the Z-axis depending on the acoustic signal, and the direction of the displacement changes sequentially, whereby vibration is generated and an acoustic wave corresponding to the vibration state (frequency, amplitude, and phase) is generated from the vibrating member 1010. The generated acoustic wave passes through the elastic members 1030, the electrodes 1020, the spacers 1040, the covers 1050, and the protection members 1060, having acoustic transmission property, and is radiated to the outside of the electrostatic loudspeaker 1001.

Since the spacers 1040, the covers 1050, the protection members 1060 are provided outside the electrodes 1020, a human body does not touch the electrodes 1020, whereby electric shock can be prevented. Furthermore, since the conductive membrane of the cover 1050U and the conductive membrane of the cover 1050L are connected to the ground GND of the drive circuit 1100 and have the same potential, electric shock can be prevented. Moreover, since the covers 1050 have waterproof property, a risk in which liquid reaches the electrodes 1020 and the vibrating member 1010 and the insulation properties thereof are lowered is decreased.

[Modifications]

Although the second embodiment of the present invention has been described above, the present invention is not limited to the above-mentioned second embodiment, but can be implemented in various embodiments. For example, the present invention may be implemented by modifying the above-mentioned second embodiment as described below. The above-mentioned second embodiment and the following modifications may be combined as necessary.

In the above-mentioned second embodiment, the electrostatic loudspeaker 1001 is equipped with the protection members 1060; however, the electrostatic loudspeaker 1001 may not be required to be equipped with the protection members 1060.

In the above-mentioned second embodiment, an adhesive is applied to the edge portions of the respective members and the members are bonded to the other members; however, the portions to which an adhesive is applied are not limited to the edge portions of the members. For example, an adhesive may be applied to the respective members in a grid shape and the members may be bonded to the other members. Furthermore, it may be possible that areas to which an adhesive is applied in dots are provided regularly in a matrix form, for example, on the respective members and the respective members are bonded to the other members.

Moreover, the method for preventing the members from being displaced from one another in the electrostatic loudspeaker 1001 is not limited to the method for performing fixation using an adhesive, but a double-faced adhesive tape, for example, may be used to secure the members to one another.

Besides, in the above-mentioned second embodiment, a conductive membrane is formed on the entire face of the insulation layer of the cover member 1050; however, the conductive membrane may not be formed on the entire face of the insulation layer. For example, the conductive membrane may be formed in a grid shape on the face of the insulation layer of the cover 1050. The size of the mesh of the grid is preferably a size not allowing a human finger to pass therethrough.

In the above-mentioned second embodiment, the electrode 1020 has a configuration in which a conductive membrane is formed on the surface of the film; however, the configuration of the electrode 1020 is not limited to this configuration. For example, a metal plate having conductivity may be used as the electrode 1020. Furthermore, it may be possible that cloth woven with conductive threads is formed into a rectangular shape and the cloth formed into the rectangular shape is used as the electrode 1020. Moreover, it may be possible that a conductive membrane is formed on a substrate obtained by forming a material (for example, glass or phenol resin) having insulation property into a plate shape and the member thus obtained is used as the electrode 1020.

In the above-mentioned second embodiment, the electrode 1020 has a rectangular shape as viewed from a point on the Z-axis; however, the shape of the electrode 1020 is not limited to the rectangular shape. For example, other shapes, such as a circular shape, an elliptic shape, and a polygonal shape, may be used. Furthermore, also in the vibrating member 1010, the shape thereof is not limited to the rectangular shape as viewed from a point on the Z-axis; for example, other shapes, such as a circular shape, an elliptic shape, and a polygonal shape, may be used. Moreover, the shape of the electrostatic loudspeaker 1001 is not limited to the rectangular shape as viewed from a point on the Z-axis; for example, other shapes, such as a circular shape, an elliptic shape, and a polygonal shape, may be used.

In the above-mentioned second embodiment, the electrostatic loudspeaker 1001 has a configuration in which the vibrating member 1010 is held between the electrode 1020U and the electrode 1020L; however, the electrostatic loudspeaker 1001 may have a single-end configuration in which the electrode 1020 is disposed only on the front face (or the back face) of the vibrating member 1010.

In the above-mentioned second embodiment, the dimensions of the respective members excluding the vibrating member 1010 in the X-axis direction and the dimensions thereof in the Y-axis direction are the same; however, the dimensions may be different depending on the respective members. For example, the dimensions of the cover 1050 in the X-axis direction and in the Y-axis direction may be longer than those of the other members. Furthermore, in the case that the dimensions of the cover 1050 in the X-axis direction and in the Y-axis direction are longer than those of the other members as described above, it may be possible that the edges of the cover 1050U and the edges of the cover 1050L are bonded to each other and the vibrating member 1010, the elastic members 1030, and the electrodes 1020 are placed in the hermetically-sealed space between the cover 1050U and the cover 1050L. With this configuration, since the space in which the vibrating member 1010, the elastic members 1030, and the electrodes 1020 are placed is hermetically sealed, liquid is prevented from reaching current flowing portions from the outside, whereby the insulation properties thereof can be prevented from lowering.

In addition, a configuration may be used in which the lengths of the electrode 1020 in the X-axis direction and in the Y-axis direction are longer than the lengths of the vibrating member 1010 in the X-axis direction and in the Y-axis direction and shorter than the lengths of the elastic member 1030 in the X-axis direction and in the Y-axis direction.

Figure 18:
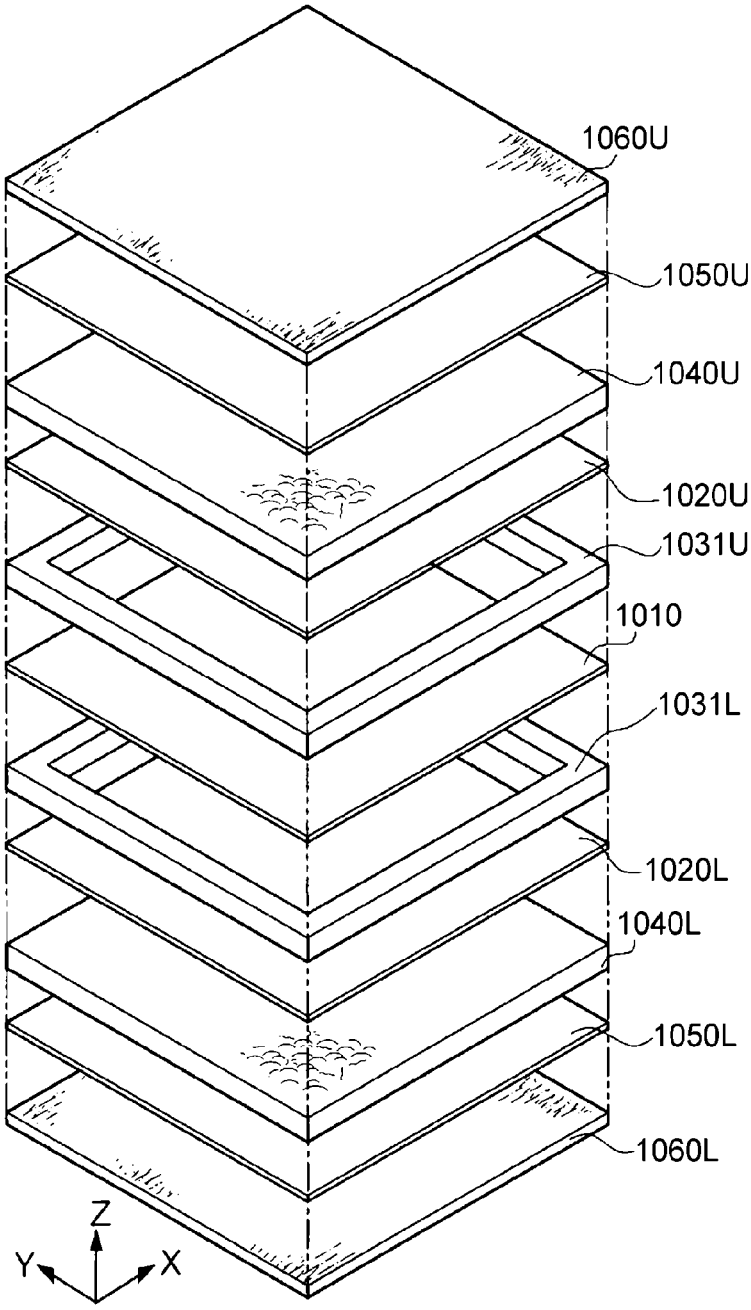
FIG. 18 is an exploded view showing an electrostatic loudspeaker according to a modification of the second embodiment of the present invention.

In the above-mentioned second embodiment, the elastic member 1030 is disposed between the electrode 1020 and the vibrating member 1010 so that the electrode 1020 does not make contact with the vibrating member 1010; however, the configuration structured so that the electrode 1020 does not make contact with the vibrating member 1010 is not limited to the configuration of the above-mentioned second embodiment. For example, the electrode 1020 may be prevented from making contact with the vibrating member 1010 by disposing a spacer formed of an insulator between the electrode 1020 and the vibrating member 1010. FIG. 18 is an exploded view showing an electrostatic loudspeaker according to this modification. Spacers 1031U and 1031L are formed of a synthetic resin insulator having rigidity, and the shape thereof is a rectangular frame shown in FIG. 18. In the second embodiment, the height of the spacer 1031U and the height of the spacer 1031L are the same.

In the electrostatic loudspeaker 1001, the electrode 1020L is secured to the lower face of the spacer 1031L and the electrode 1020U is secured to the upper face of the spacer 1031U. In addition, the vibrating member 1010 is firmly bonded to the upper face of the 1031L and the lower face of the spacer 1031U is firmly bonded to the upper face of the vibrating member 1010.

In this modification, the vibrating member 1010 is secured between the frames of the spacer 1031U and the spacer 1031L in a state of being subjected to a tension force so as not to become loose. With this configuration, a distance is preserved between the electrode 1020 and the vibrating member 1010 using the spacers 1031U and 1031L, whereby the vibrating member 1010 does not make contact with the electrode 1020 even if the vibrating member 1010 vibrates.

Figure 19:
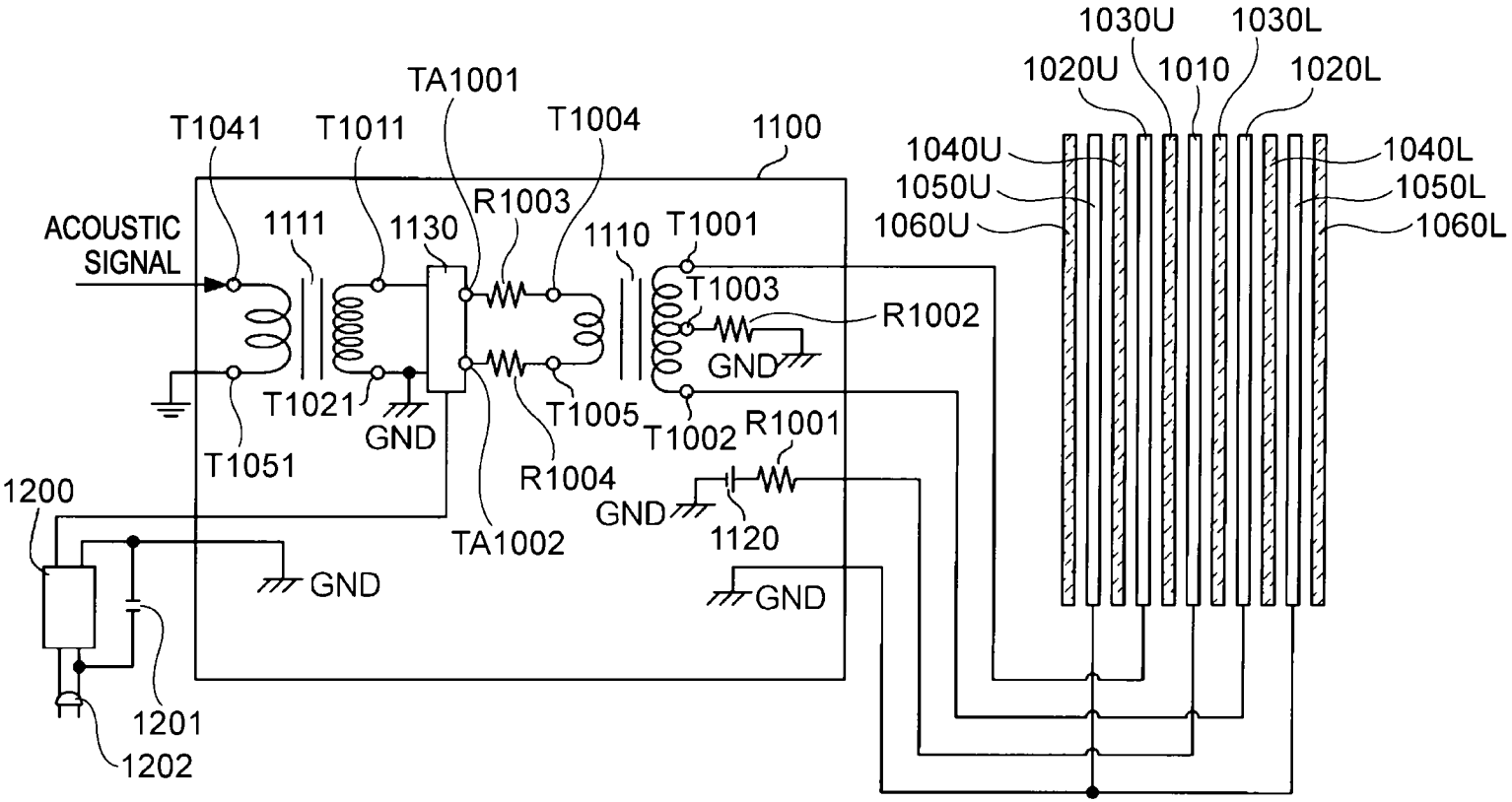
FIG. 19 is a view showing the electrical configuration of a drive circuit according to a modification of the second embodiment of the present invention.

In the present invention, the configuration of the drive circuit 1100 may be modified to the configuration shown in FIG. 19. In FIG. 19, components having the same configurations as those in the above-mentioned second embodiment are designated by the same numerals and signs and their descriptions are omitted.

In FIG. 19, a transformer 1111 is an insulating transformer; the primary side thereof is electrically insulated from the secondary side thereof. An acoustic signal is input to one terminal T1041 on the primary side of the transformer 1111. In addition, the other terminal T1051 on the primary side of the transformer 1111 is grounded. Furthermore, one terminal T1011 on the secondary side of the transformer 1111 is connected to the amplifier 1130, and the other terminal T1021 on the secondary side of the transformer 1111 is connected to the ground GND and the amplifier 1130.

An AC (Alternating Current) adaptor 1200 is a switching AC adaptor, and the adaptor rectifies an AC voltage obtained from an AC plug 1202 and converts the voltage into a DC voltage. The DC voltage obtained by this rectification serves as the power supply of the amplifier 1130. The plus side of the output of the AC adaptor 1200 is connected to the amplifier 1130 and the minus side thereof is connected to the ground GND of the drive circuit 1100. Furthermore, the conductive wire on the minus side of the output of the AC adaptor 1200 and the conductive wire on the ground side of the AC plug 1202 are connected to each other via a capacitor 1201. The capacitance of the capacitor 1201 is preferably 1000 pF or less; in the case that the capacitance is equal to or less than this value, even if a human body touches the electrode 1020, the current flowing through the human body can be suppressed.

Figure 20:
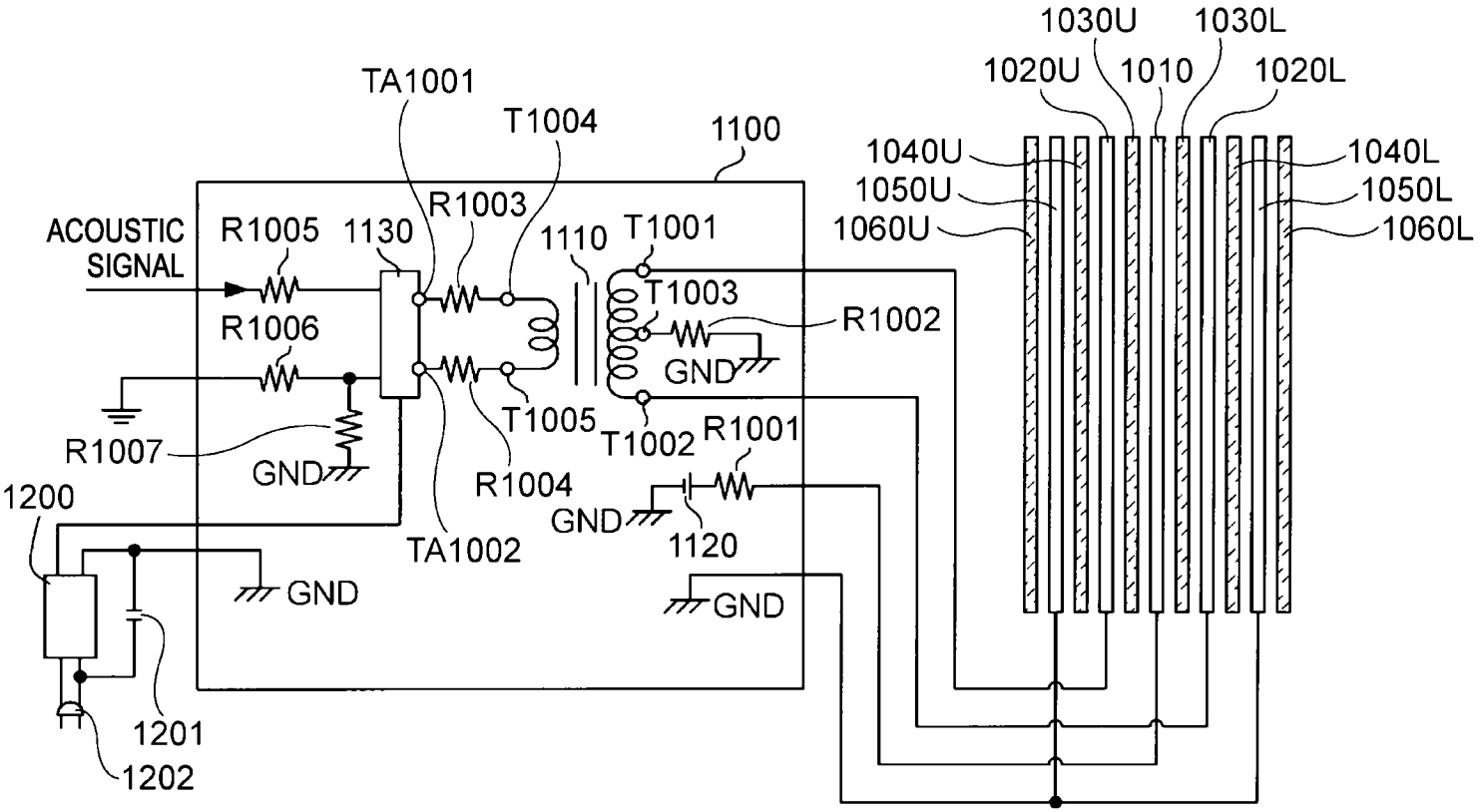
FIG. 20 is a view showing the electrical configuration of a drive circuit according to a modification of the second embodiment of the present invention.

In the drive circuit 1100, the ground GND of the drive circuit 1100 should only be grounded through high impedance, and the drive circuit 1100 may have the configuration shown in FIG. 20. In FIG. 20, components having the same configurations as those shown in FIG. 19 are designated by the same numerals and signs and their descriptions are omitted. In the configuration shown in FIG. 20, an acoustic signal is input to the amplifier 1130 via a resistor R1005. Furthermore, the ground of the amplifier 1130 is grounded via a resistor R1006 and connected to the ground GND via a resistor R1007. In the configurations shown in FIGS. 19 and 20, even if the cover 1050 is broken and a human body touches the electrode 1020, the current flowing through the human body can be suppressed.

DESCRIPTION OF REFERENCE NUMERALS AND SIGNS

1 . . . electrostatic loudspeaker, 11 . . . main body, 10 . . . vibrating membrane, 20 . . . elastic member, 30 . . . electrode, 12 . . . cover member, 40 . . . first cover member, 401 . . . adhesion area, 402 . . . non-adhesion area, 50 . . . second cover member, 501 . . . adhesion area, 502 . . . non-adhesion area, 60 . . . third cover member, 601 . . . adhesion area, 602 . . . non-adhesion area, 71*e* . . . image, 100 . . . driver, 110 . . . transformer, 120 . . . amplifier, 130 . . . bias supply, 61 . . . mesh, 1001 . . . electrostatic loudspeaker, 1010 . . . vibrating member, 1020, 1020U, 1020L . . . electrode, 1030, 1030U, 1030L . . . elastic member, 1031U, 1031L . . . spacer, 1040, 1040U, 1040L . . . spacer, 1050, 1050U, 1050L . . . cover, 1060, 1060U, 1060L . . . protection member, 1100 . . . drive circuit, 1110 . . . transformer, 1111 . . . transformer, 1120 . . . bias supply, 1130 . . . amplifier, 1200 . . . AC adaptor, 1201 . . . capacitor, 1202 . . . AC plug

The invention claimed is:

1. An electrostatic loudspeaker comprising:

a vibrating member;

an electrode disposed so as to be opposed to the vibrating member, and having acoustic transmission property;

a first cover member disposed on an opposite side of a face of the electrode, which is opposed to the vibrating member, and having acoustic transmission property; and a second cover member disposed on an opposite side of a face of the first cover member, which is opposed to the electrode, and having waterproof property and insulation property, wherein the second cover member includes a conductive membrane formed on an entire area of at least one face of the second cover member, and the conductive membrane is electrically connected to a ground of a drive circuit configured to supply an acoustic signal to the electrode.

2. The electrostatic loudspeaker according to claim 1, wherein the vibrating member is a vibrating membrane, and an elastic member having elasticity, insulation property, and acoustic transmission property, is disposed between the vibrating membrane and the electrode.

3. The electrostatic loudspeaker according to claim 1, wherein the first cover member is a pair of first cover members, the pair of first cover members are disposed with the electrode, the elastic member and the vibrating membrane being held therebetween, and edges of the pair of first cover members are firmly bonded to each other with the electrode, the elastic member and the vibrating membrane being disposed in a space formed between the pair of first cover members, the second cover member is a pair of second cover members, the pair of second cover members are disposed with the electrode, the elastic member, the vibrating membrane and the pair of first cover members being held therebetween, and edges of the pair of second cover members are firmly bonded to each other with the electrode, the elastic member, the vibrating membrane and the pair of first cover members being disposed in a space formed between the pair of second cover members, and the third cover member is a pair of third cover members, the pair of third cover members are disposed with the electrode, the elastic member, the vibrating membrane, the pair of first cover members and the pair of second cover members being held therebetween, and edges of the pair of third cover members are firmly bonded to each other with the electrode, the elastic member, the vibrating membrane, the pair of first cover members and the pair of second cover members being disposed in a space formed between the pair of the third cover members.

4. The electrostatic loudspeaker according to claim 1, wherein a third cover member having acoustic transmission property is disposed on an opposite side of a face of the second cover member, which is opposed to the first cover member.

5. An electrostatic loudspeaker comprising:

a vibrating member;

an electrode disposed so as to be opposed to the vibrating member;

a spacer member disposed on an opposite side of a face of the electrode, which is opposed to the vibrating member, and having acoustic transmission property; and a cover member disposed on an opposite side of a face of the spacer member, which is opposed to the electrode, and having waterproof property and insulation property, wherein the electrode has acoustic transmission property, the vibrating member is a vibrating membrane, an elastic member having elasticity, insulation property, and acoustic transmission property, is disposed between the vibrating membrane and the electrode the spacer member is a first cover member having elasticity, the cover member is a second cover member having acoustic transmission property, a third cover member having acoustic transmission property is disposed on an opposite side of a face of the second cover member, which is opposed to the first cover member, the first cover member is a pair of first cover members, the pair of first cover members are disposed with the electrode, the elastic member and the vibrating membrane being held therebetween, and edges of the pair of first cover members are firmly bonded to each other with the electrode, the elastic member and the vibrating membrane being disposed in a space formed between the pair of first cover members, the second cover member is a pair of second cover members, the pair of second cover members are disposed with the electrode, the elastic member, the vibrating membrane and the pair of first cover members being held therebetween, and edges of the pair of second cover members are firmly bonded to each other with the electrode, the elastic member, the vibrating membrane and the pair of first cover members being disposed in a space formed between the pair of second cover members, and the third cover member is a pair of third cover members, the pair of third cover members are disposed with the electrode, the elastic member, the vibrating membrane, the pair of first cover members and the pair of second cover members being held therebetween, and edges of the pair of third cover members are firmly bonded to each other with the electrode, the elastic member, the vibrating membrane, the pair of first cover members and the pair of second cover members being disposed in a space formed between the pair of the third cover members.

6. An electrostatic loudspeaker comprising:

a vibrating member;

an electrode disposed so as to be opposed to the vibrating member;

a spacer member disposed on an opposite side of a face of the electrode, which is opposed to the vibrating member, and having acoustic transmission property; and a cover member disposed on an opposite side of a face of the spacer member, which is opposed to the electrode, and having waterproof property and insulation property, wherein the vibrating member has conductivity, the electrode is a pair of electrodes disposed with the vibrating member being held therebetween, the cover member is a pair of covers each of which includes a film having the waterproof property and the insulation property and a conductive membrane formed on an entire area of at least one face of the film, and which are disposed with the vibrating member and the pair of electrodes being held therebetween, the spacer member is a pair of spacers each of which is disposed between the pair of covers and the pair of electrodes, and each of which has insulation property, and the pair of covers are electrically connected to each other and connected to a ground of a drive circuit configured to supply a first acoustic signal to one of the pair of electrodes and a second acoustic signal having inverted polarity of polarity of the first acoustic signal to the other of the pair of electrodes.

7. The electrostatic loudspeaker according to claim 6, wherein edges of the pair of covers are firmly bonded to each other, and the vibrating member and the pair of electrodes are disposed in a space formed between the pair of covers.

8. The electrostatic loudspeaker according to claim 7, wherein the drive circuit includes an amplifier circuit configured to amplify an input signal, the first acoustic signal is a signal obtained when an acoustic signal input to the amplifier circuit is amplified by the amplifier circuit so that the signal has a same phase as that of the acoustic signal, and the second acoustic signal is a signal obtained when the acoustic signal input to the amplifier circuit is amplified by the amplifier circuit so that the signal has polarity opposite to that of the acoustic signal, and the drive circuit includes an insulating transformer in which the acoustic signal is input to one terminal on a primary side thereof, the other terminal on the primary side thereof is grounded, one terminal on a secondary side thereof is connected to the amplifier circuit, and the other terminal on the secondary side thereof is connected to the ground of the drive circuit.

9. The electrostatic loudspeaker according to claim 6, wherein the drive circuit includes an amplifier circuit configured to amplify an input signal, the first acoustic signal is a signal obtained when an acoustic signal input to the amplifier circuit is amplified by the amplifier circuit so that the signal has a same phase as that of the acoustic signal, and the second acoustic signal is a signal obtained when the acoustic signal input to the amplifier circuit is amplified by the amplifier circuit so that the signal has polarity opposite to that of the acoustic signal, and the drive circuit includes an insulating transformer in which the acoustic signal is input to one terminal on a primary side thereof, the other terminal on the primary side thereof is grounded, one terminal on a secondary side thereof is connected to the amplifier circuit, and the other terminal on the secondary side thereof is connected to the ground of the drive circuit.

* * * * *